US011821281B2

(12) United States Patent
Swor et al.

(10) Patent No.: US 11,821,281 B2
(45) Date of Patent: Nov. 21, 2023

(54) SYSTEMS AND METHODS FOR FLOW-ACTIVATED INITIATION OF PLUG ASSEMBLY FLOW SEATS

(71) Applicant: Paramount Design LLC, Duncan, OK (US)

(72) Inventors: Loren Swor, Duncan, OK (US); Brian Wilkinson, Duncan, OK (US)

(73) Assignee: Paramount Design LLC, Duncan, OK (US)

( * ) Notice: Subject to any disclaimer, the term of this patent is extended or adjusted under 35 U.S.C. 154(b) by 0 days.

(21) Appl. No.: 17/405,690

(22) Filed: Aug. 18, 2021

(65) Prior Publication Data

US 2022/0325598 A1 Oct. 13, 2022

Related U.S. Application Data

(60) Provisional application No. 63/209,059, filed on Jun. 10, 2021, provisional application No. 63/173,075, filed on Apr. 9, 2021.

(51) Int. Cl.
*E21B 33/12* (2006.01)
*E21B 33/13* (2006.01)

(52) U.S. Cl.
CPC ..... *E21B 33/12* (2013.01); *E21B 33/13* (2013.01)

(58) Field of Classification Search
CPC ..... E21B 33/12; E21B 33/13; E21B 33/12955
See application file for complete search history.

(56) References Cited

U.S. PATENT DOCUMENTS

| | | | | |
|---|---|---|---|---|
| 9,835,003 | B2 * | 12/2017 | Harris | E21B 33/1208 |
| 10,156,119 | B2 * | 12/2018 | Martin | E21B 23/04 |
| 10,227,842 | B2 * | 3/2019 | Kellner | E21B 34/14 |
| 10,408,012 | B2 * | 9/2019 | Martin | E21B 33/1277 |
| 10,472,927 | B2 | 11/2019 | Marcin et al. | |
| 10,563,476 | B2 | 2/2020 | Smith et al. | |
| 10,989,016 | B2 * | 4/2021 | Tonti | E21B 33/1293 |
| 11,125,039 | B2 * | 9/2021 | Kellner | E21B 33/128 |
| 11,131,162 | B2 * | 9/2021 | Hern | E21B 33/128 |
| 11,261,683 | B2 * | 3/2022 | Kellner | E21B 23/01 |
| 2018/0016864 | A1 * | 1/2018 | Parekh | E21B 33/1291 |
| 2019/0093448 | A1 | 3/2019 | Rochen et al. | |
| 2019/0106962 | A1 * | 4/2019 | Lee | E21B 33/128 |
| 2020/0347694 | A1 * | 11/2020 | Power | E21B 33/1293 |
| 2022/0290525 | A1 * | 9/2022 | Wilkinson | E21B 33/128 |

* cited by examiner

*Primary Examiner* — Steven A MacDonald
(74) *Attorney, Agent, or Firm* — Edward L. White, P.C.; Ed White

(57) ABSTRACT

The present disclosure describes systems and methods for flow-activated plug assembly flow seat initiation, which in some aspects may comprise sealing a plug within a downhole bore, and may include a plug assembly comprising a frustoconical tube; a tubular mandrel positioned longitudinally through the frustoconical tube and having port(s) fluidly connecting a mandrel bore with the bore of the frustoconical tube, and having a shear ring extending from the mandrel; and a ball configured to fluidly seal the proximal end of the tubular mandrel; wherein the tubular mandrel is configured to move between a first position having a fluid passageway through the ports and a second position wherein the shear ring has been sheared away when a predetermined fluid pressure is applied to the plug assembly and the tubular mandrel is positioned relative to the frustoconical tube such that the port(s) are blocked, closing the fluid passageway.

22 Claims, 26 Drawing Sheets

SYSTEMS AND METHODS FOR FLOW-ACTIVATED INITIATION OF PLUG ASSEMBLY FLOW SEATS

CROSS-REFERENCE TO RELATED APPLICATIONS

This application claims priority to the provisional patent application identified by U.S. Ser. No. 63/173,075, filed Apr. 9, 2021, titled "System and Method for Flow-Activated Plug Assembly Flow Seat Initiation", and to the provisional patent application identified by U.S. Ser. No. 63/209,059, filed Jun. 10, 2021, titled "System and Method for Flow-Activated Plug Assembly Flow Seat Initiation", the entire contents of each of which are hereby expressly incorporated herein by reference.

FIELD OF THE DISCLOSURE

The disclosure generally relates to methods and apparatuses for sealing downhole plugs, such as for oil and gas production. More particularly the disclosure relates to methods and apparatuses for stopping fluid flow through a plug, such as a frac plug, by seating a ball or other stopper in the plug set in a downhole environment, such as within a casing.

BACKGROUND

The extraction of oil and gas from the ground often involves plugging a drilled hole, either partially or completely, during various phases of the extraction. For example, plugs may be used to temporarily block passage of oil, gas, and/or water on one side of the plug and/or fluids pumped down the drilled hole on the other side of the plug. In some implementations, one or more plugs are used in hydraulic fracturing ("fracking") processes. Such plugs may be referred to as "frac plugs."

Traditionally, some frac plugs are initially deployed and set within a casing and/or tubing in a bore hole in an initial configuration in which fluid can flow through the plug and on through the casing past the plug. To isolate the portions of the casing beyond and before the plug (such as to complete fracking in stages in the wellbore), a ball may be set into an interior of the plug using fluid pressure. Once the ball is set into the plug, fluid can no longer pass through the plug. One approach to setting the ball in the plug, known as "ball in place," seats the ball in the plug immediately as soon as fluid flow begins, thus blocking fluid from flowing through the plug.

For the "ball in place" method, typically the plug with the ball, a setting tool for the plug, and one or more perforation guns are run into the wellbore using fluid pressure. The plug is "set" in the wellbore casing and secured against interior walls of the casing with the setting tool, while maintaining a flow path through the plug. Next, the wellbore and rock formation are perforated above the plug through a series of small explosions using the perforation gun. Fluid flow is introduced into the wellbore to push fluid into the perforations, which also immediately seats the ball in place in the plug, stopping fluid moving through the plug, and forces fluid into the perforations that are located in the casing and rock upstream of the plug, causing fracturing of the rock formations.

However, in some cases the perforation step is incomplete. For example, the perforation gun may fail to produce the desired perforations in the rock formations. In this case, the perforation gun may be retrieved from the wellbore and the problem in the gun fixed. Then the perforation gun needs to be sent back into the wellbore. However, since the ball is already set in the plug, no additional fluid can be pushed past the plug, so there is no additional fluid flow or pressure available to move the perforation gun back into position in the wellbore. In other words, the wellbore is dead-headed (pressurized). In place of placing the perforation gun into position with fluid pressure, other mechanical methods may be used, such as using coil tubing, or drilling out the plug and starting over, but these other methods are time consuming and costly.

Another approach to setting a ball in the plug is to drop the ball from the surface of the well and seat the dropped ball in the plug using the fluid flow from the surface after the perforation step is complete. However, this approach has other disadvantages. For example, the perforation gun(s) must be removed from the wellbore after firing in each section of the wellbore (where a section is defined between plugged areas) in order to push the ball into place into the plug for that section using fluid flow. This extra step can be time consuming and costly.

What is needed are apparatuses and methods that have the advantage that the perforation gun(s) or other tools need not be removed after perforating each section, and that also allow fluid flow through the plug so that the perforation gun(s) or other tools may be retrieved and, if needed, repositioned by using fluid flow instead of repositioned using other time consuming and costly methods.

SUMMARY

Apparatuses and methods for stopping fluid flow through a plug at a predetermined fluid pressure are disclosed. The problems of previous systems, including requiring perforation guns to be removed after perforating each section of a wellbore and/or of not being able to use fluid flow to reposition faulty perforation guns or other tools, are addressed through the use of flow-activated ball seat systems and methods that seal a plug only when a predetermined level of fluid pressure is reached. In accordance with some aspects of the present disclosure, plug assemblies may be set and sealed in a casing when exposed to a first predetermined fluid flow/pressure, but still allowing fluid passage through the plug assembly, and then sealed such that fluid cannot pass through the plug assembly at a second predetermined fluid flow/pressure.

BRIEF DESCRIPTION OF THE DRAWINGS

The accompanying drawings, which are incorporated in and constitute a part of this specification, illustrate one or more implementations described herein and, together with the description, explain these implementations. The drawings are not intended to be drawn to scale, and certain features and certain views of the figures may be shown exaggerated, to scale or in schematic in the interest of clarity and conciseness. Not every component may be labeled in every drawing. Like reference numerals in the figures may represent and refer to the same or similar element or function. In the drawings.

DETAILED DESCRIPTION

Figure 1:
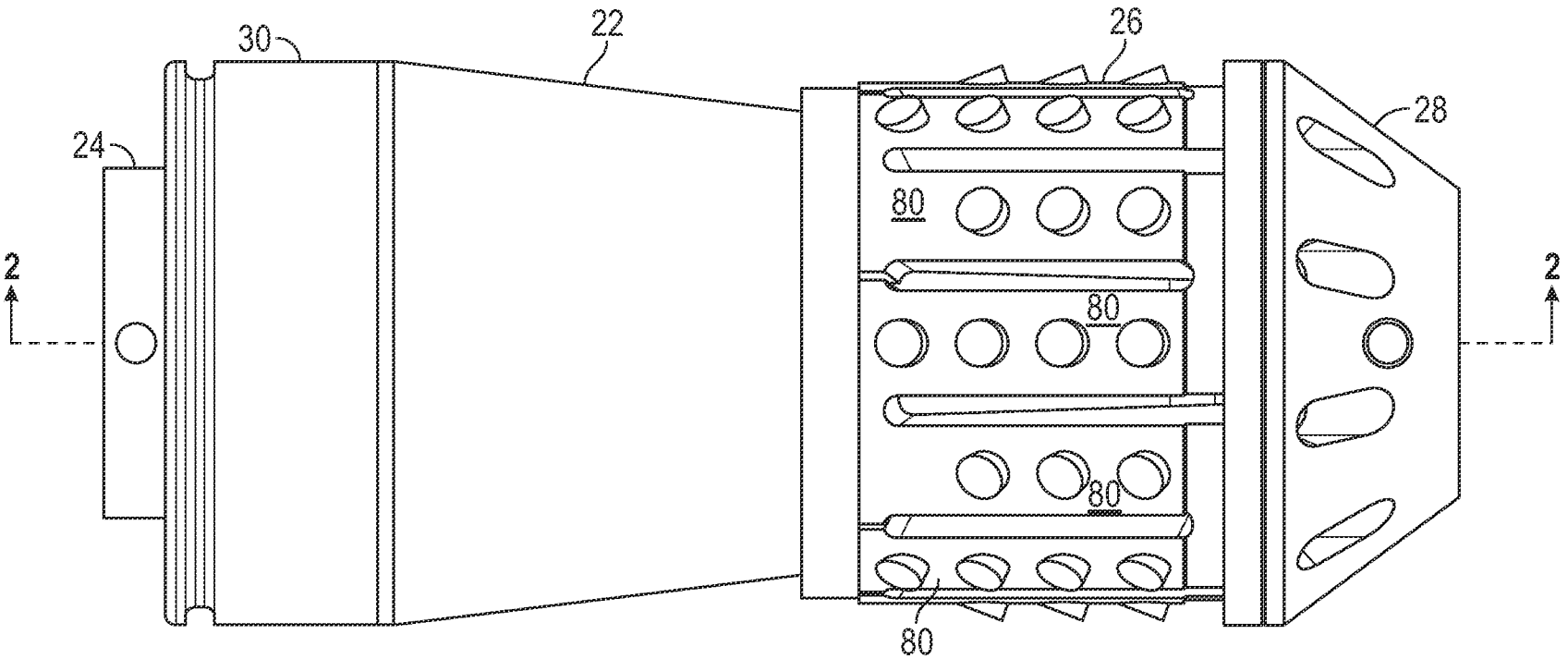
FIG. 1 is a side view of an exemplary plug assembly, in which the plug assembly is in an initial state, in accordance with the present disclosure.

The following detailed description refers to the accompanying drawings. The same reference numbers in different drawings may identify the same or similar elements.

The mechanisms proposed in this disclosure circumvent the problems described above. The present disclosure describes a method for setting and sealing a plug, such as a frac plug, in a casing within a bore, while allowing fluid flow through the plug assembly until a predetermined fluid pressure is applied to the plug assembly.

In one aspect of the present disclosure, a plug assembly may comprise a frustoconical tube having first end, a second end, an exterior surface, and an interior surface, the interior surface defining a tube bore extending longitudinally through the frustoconical tube through the first end and the second end, the interior surface having a first step circumferentially between the first end and the second end, the first end having a first inner diameter and the second end having a second inner diameter smaller than the first inner diameter; a tubular mandrel positioned longitudinally through the tube bore of the frustoconical tube, the tubular mandrel having a proximal end proximate to the first end of the frustoconical tube, a distal end extending through the second end of the frustoconical tube, an exterior surface, an interior surface defining a mandrel bore longitudinally through the tubular mandrel through the proximal end and the distal end, one or more ports between the proximal end and the distal end fluidly connecting the mandrel bore with the exterior surface, and a shear ring extending from the exterior surface and positioned between the one or more ports and the distal end; and a sealing element, such as a ball, positionable at least partially in the mandrel bore of the tubular mandrel at the proximal end and configured to fluidly seal the proximal end of the tubular mandrel; wherein the tubular mandrel is configured to move between a first position and a second position in the frustoconical tube; wherein in the first position the tubular mandrel is positioned relative to the frustoconical tube such that the shear ring contacts the interior surface of the frustoconical tube between the first step of the frustoconical tube and the first end of the frustoconical tube, and such that a fluid passageway is formed between the exterior surface of the mandrel and the tube bore of the frustoconical tube, through the one or more ports of the tubular mandrel, and through the distal end of the tubular mandrel; and wherein in the second position the shear ring has been sheared away by the first step of the frustoconical tube when a predetermined fluid pressure is applied to the plug assembly, and wherein the tubular mandrel is positioned relative to the frustoconical tube such that the interior surface of the frustoconical tube blocks the one or more ports, thereby closing the fluid passageway.

In one implementation, a method for sealing a plug assembly in a wellbore may comprise deploying a plug assembly and a setting tool into a casing within a drilled wellbore, the plug assembly may comprise: a frustoconical tube having first end, a second end, an exterior surface, and an interior surface, the interior surface defining a tube bore extending longitudinally through the frustoconical tube through the first end and the second end, the first end having a first inner diameter and the second end having a second inner diameter smaller than the first inner diameter, the interior surface having a first step circumferentially between the first end and the second end; a tubular mandrel positioned longitudinally through the tube bore of the frustoconical tube, the tubular mandrel having a proximal end proximate to the first end of the frustoconical tube, a distal end extending through the second end of the frustoconical tube, an exterior surface, an interior surface defining a mandrel bore longitudinally through the tubular mandrel through the proximal end and the distal end, one or more ports between the proximal end and the distal end fluidly connecting the mandrel bore with the exterior surface, and a shear ring extending from the exterior surface and positioned between the one or more ports and the distal end; a ball positionable at least partially in the mandrel bore of the tubular mandrel at the proximal end and configured to fluidly seal the proximal end of the tubular mandrel; and a slip member having one or more slip segments, the slip member positioned at least partially around the second end of the frustoconical tube such that the slip segments are pushed outwardly when the second end of the frustoconical tube moves longitudinally, the slip member having a sloped interior surface configured to engage the second end of the exterior surface of the frustoconical tube.

The method may further comprise securing the plug assembly in the casing by introducing fluid flow into the casing to longitudinally move the frustoconical tube with the setting tool, thereby expanding the slip segments of the slip member and coupling the plug assembly to the casing with the slip segments; wherein the tubular mandrel of the plug assembly is in a first position relative to the frustoconical tube such that the shear ring contacts the interior surface of the frustoconical tube between the first step of the frustoconical tube and the first end of the frustoconical tube, and such that a fluid passageway is formed between the exterior surface of the mandrel and the tube bore of the frustoconical tube, through the one or more ports of the tubular mandrel, and through the distal end of the tubular mandrel; and increasing the fluid flow above a predetermined flow rate to shear the shear ring, causing the tubular mandrel to move to a second position relative to the frustoconical tube, in which the interior surface of the frustoconical tube blocks the one or more ports and closes the fluid passageway.

In one implementation, a plug assembly may comprise a frustoconical tube having first end, a second end, an exterior surface, and an interior surface, the interior surface defining a tube bore extending longitudinally through the frustoconical tube through the first end and the second end, the interior surface having a first step circumferentially between the first end and the second end, and a second step circumferentially between the first step and the first end, the first end having a first inner diameter and the second end having a second inner diameter smaller than the first inner diameter; a mandrel positioned longitudinally through the tube bore of the frustoconical tube, the mandrel having a proximal end proximate to the first end of the frustoconical tube, a distal end having a first diameter and extending through the second end of the frustoconical tube, an exterior surface, a seating segment between the proximal end and the distal end, the seating segment having a second diameter greater than the first diameter of the distal end, the seating segment configured to sealingly engage with the second step of the frustoconical tube, and a shear ring extending from the exterior surface and positioned between the seating segment and the distal end; and a ported ring having an exterior surface, a first side, a second side, a thickness extending between the first side and the second side, and one or more ports extending longitudinally through the thickness, the ported ring positioned circumferentially about the mandrel between the shear ring and the distal end, the exterior surface in contact with the interior surface of the frustoconical tube, and the second side in contact with the first step of the frustoconical tube, thereby creating a fluid passageway between the interior surface of the frustoconical tube and the exterior surface of the mandrel via the one or more ports; and wherein the mandrel is configured to move to a closed position in the frustoconical tube when the shear ring has been sheared away by the ported ring when a predetermined fluid pressure is applied to the plug assembly, wherein the mandrel is positioned relative to the frustoconical tube such that seating segment of the mandrel engages the second step of the frustoconical tube, thereby blocking fluid flow to the ported ring and closing the fluid passageway.

In one implementation, a method for sealing a plug in a wellbore may comprise deploying a plug assembly and a setting tool into a casing within a drilled wellbore, the plug assembly comprising: a frustoconical tube having first end, a second end, an exterior surface, and an interior surface, the interior surface defining a tube bore extending longitudinally through the frustoconical tube through the first end and the second end, the interior surface having a first step circumferentially between the first end and the second end, and a second step circumferentially between the first step and the first end, the first end having a first inner diameter and the second end having a second inner diameter smaller than the first inner diameter; a mandrel positioned longitudinally through the tube bore of the frustoconical tube, the mandrel having a proximal end proximate to the first end of the frustoconical tube, a distal end having a first diameter and extending through the second end of the frustoconical tube, an exterior surface, a seating segment between the proximal end and the distal end, the seating segment having a second diameter greater than the first diameter of the distal end, the seating segment configured to sealingly engage with the second step of the frustoconical tube, and a shear ring extending from the exterior surface and positioned between the seating segment and the distal end; a ported ring having an exterior surface, a first side, a second side, a thickness extending between the first side and the second side, and one or more ports extending longitudinally through the thickness, the ported ring positioned circumferentially about the mandrel between the shear ring and the distal end, the exterior surface in contact with the interior surface of the frustoconical tube, the second side in contact with the first step of the frustoconical tube, thereby creating a fluid passageway between the interior surface of the frustoconical tube and the exterior surface of the mandrel via the one or more ports; and a slip member having one or more slip segments, the slip member positioned at least partially around the second end of the frustoconical tube such that the slip segments are pushed outwardly when the second end of the frustoconical tube moves longitudinally, the slip member having a sloped interior surface configured to engage the second end of the exterior surface of the frustoconical tube;

The method may further comprise securing the plug assembly in the casing by introducing fluid flow into the casing to longitudinally move the frustoconical tube with the setting tool, thereby expanding the slip segments of the slip member and coupling the plug assembly to the casing with the slip segments; wherein the mandrel of the plug assembly is in a first position relative to the frustoconical tube such that a fluid passageway is formed between the exterior surface of the mandrel and the tube bore of the frustoconical tube through the one or more ports of the ported ring; and increasing the fluid flow above a predetermined flow rate to shear the shear ring, thereby allowing the mandrel to move to a second position relative to the frustoconical tube, in which the mandrel is positioned relative to the frustoconical tube such that seating segment of the mandrel engages the second step of the frustoconical tube, thereby blocking fluid flow to the ported ring and closing the fluid passageway.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concept. This description should be read to include one or more and the singular also includes the plural unless it is obvious that it is meant otherwise.

Further, use of the term "plurality" is meant to convey "more than one" unless expressly stated to the contrary.

As used herein, qualifiers like "substantially," "about," "approximately," and combinations and variations thereof, are intended to include not only the exact amount or value that they qualify, but also some slight deviations therefrom, which may be due to manufacturing tolerances, measurement error, wear and tear, stresses exerted on various parts, and combinations thereof, for example.

The use of the term "at least one" or "one or more" will be understood to include one as well as any quantity more than one. In addition, the use of the phrase "at least one of X, V, and Z" will be understood to include X alone, V alone, and Z alone, as well as any combination of X, V, and Z.

The use of ordinal number terminology (i.e., "first", "second", "third", "fourth", etc.) is solely for the purpose of differentiating between two or more items and, unless explicitly stated otherwise, is not meant to imply any sequence or order or importance to one item over another or any order of addition.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

As discussed above, current systems for sealing plugs, such as frac plugs, in downhole casings can cause additional cost and time if more fluid flow is needed after the frac plugs are sealed in the casings, such as if other downhole tools need to be repositioned downhole, because no additional fluid flow can pass through the plug. The present disclosure addresses these and other deficiencies with systems and methodologies allowing fluid flow through plug assemblies in a casing in a downhole bore until a predetermined fluid pressure is reached for sealing the plug assembly, which mechanically shears a ring in the plug and then moves a mandrel to close one or more fluid passageway.

Figure 2:
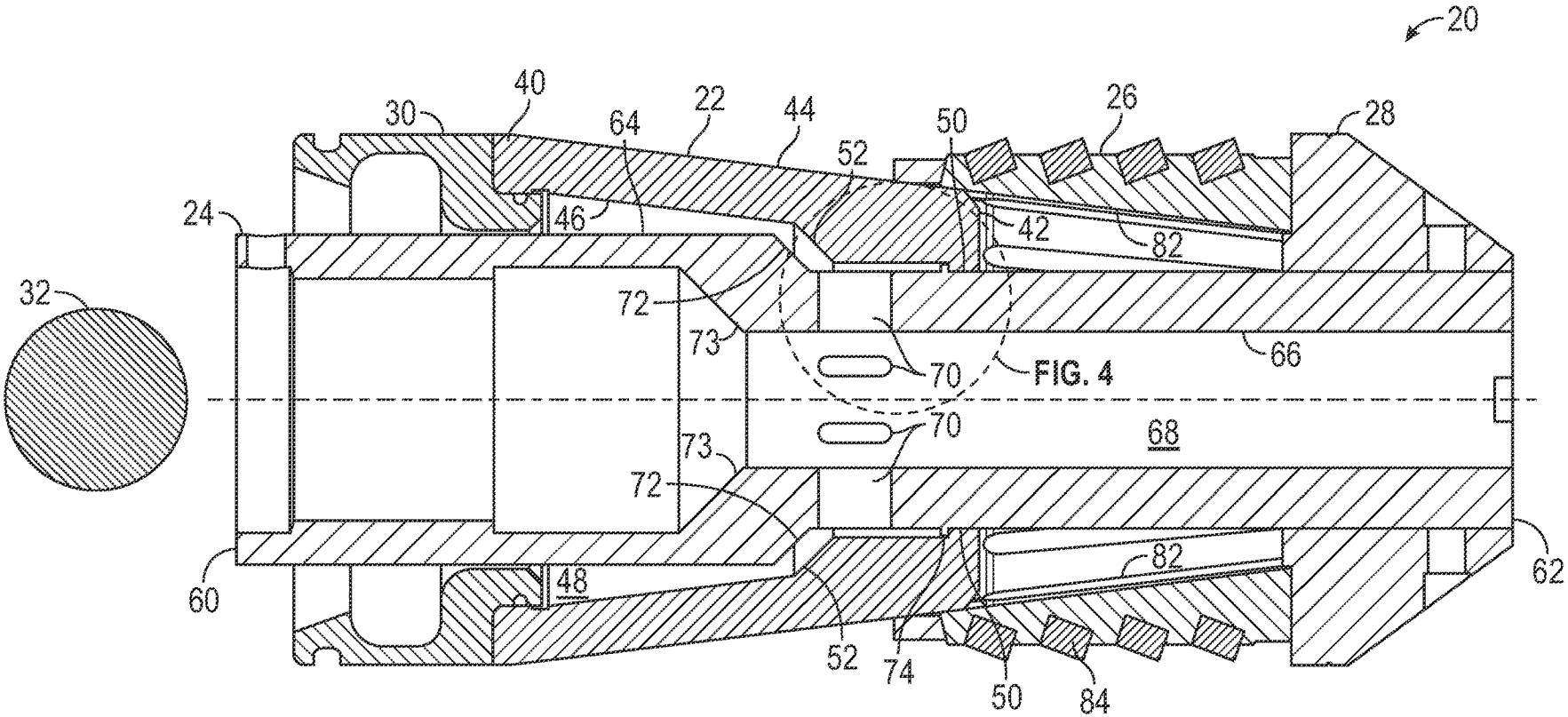
FIG. 2 is a cross-sectional view of the exemplary plug assembly of FIG. 1.
Figure 2A:
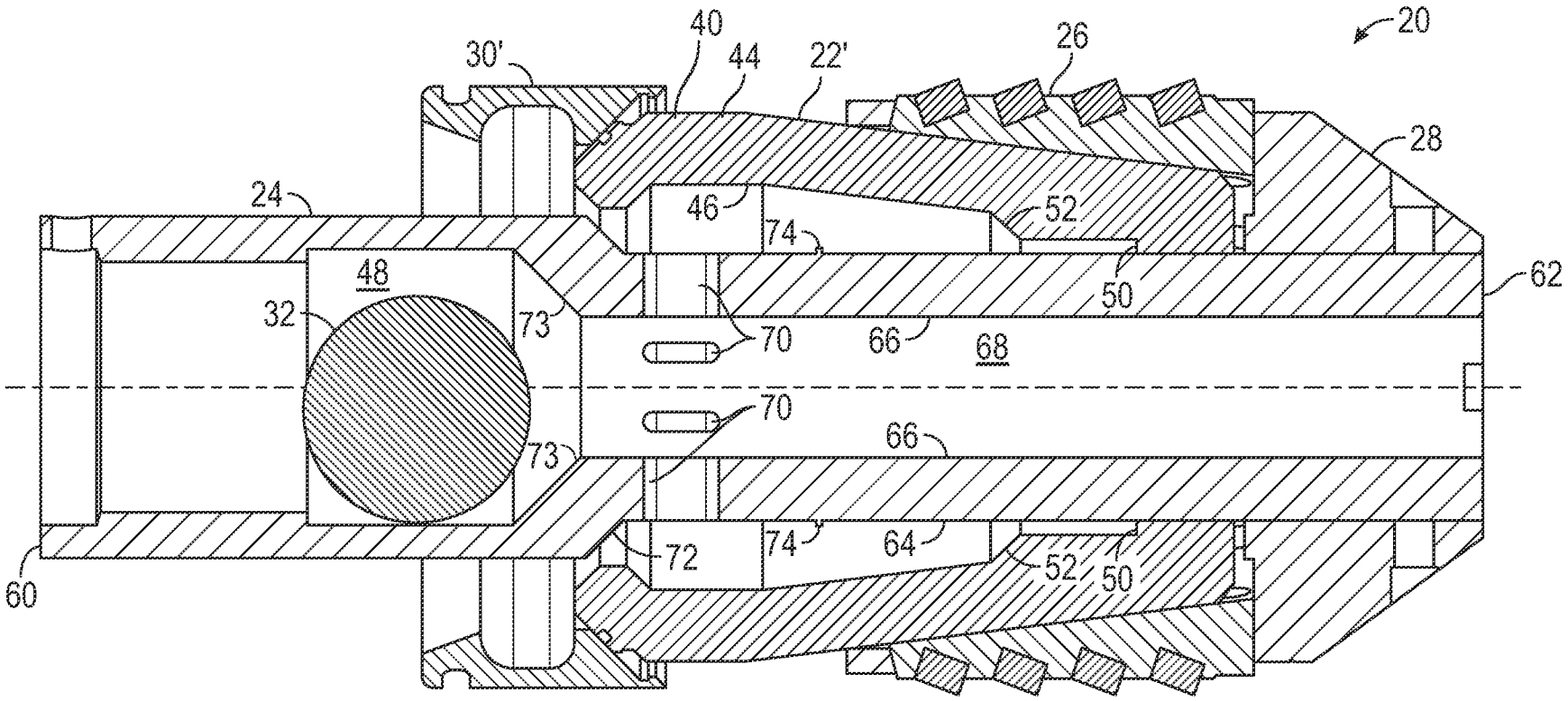
FIG. 2A is a cross-sectional view of the exemplary plug assembly of FIG. 1 in which a slip member has been set in which the plug assembly is in a first state with a tubular mandrel in a first position with a ball not yet seated within the tubular mandrel.
Figure 3:
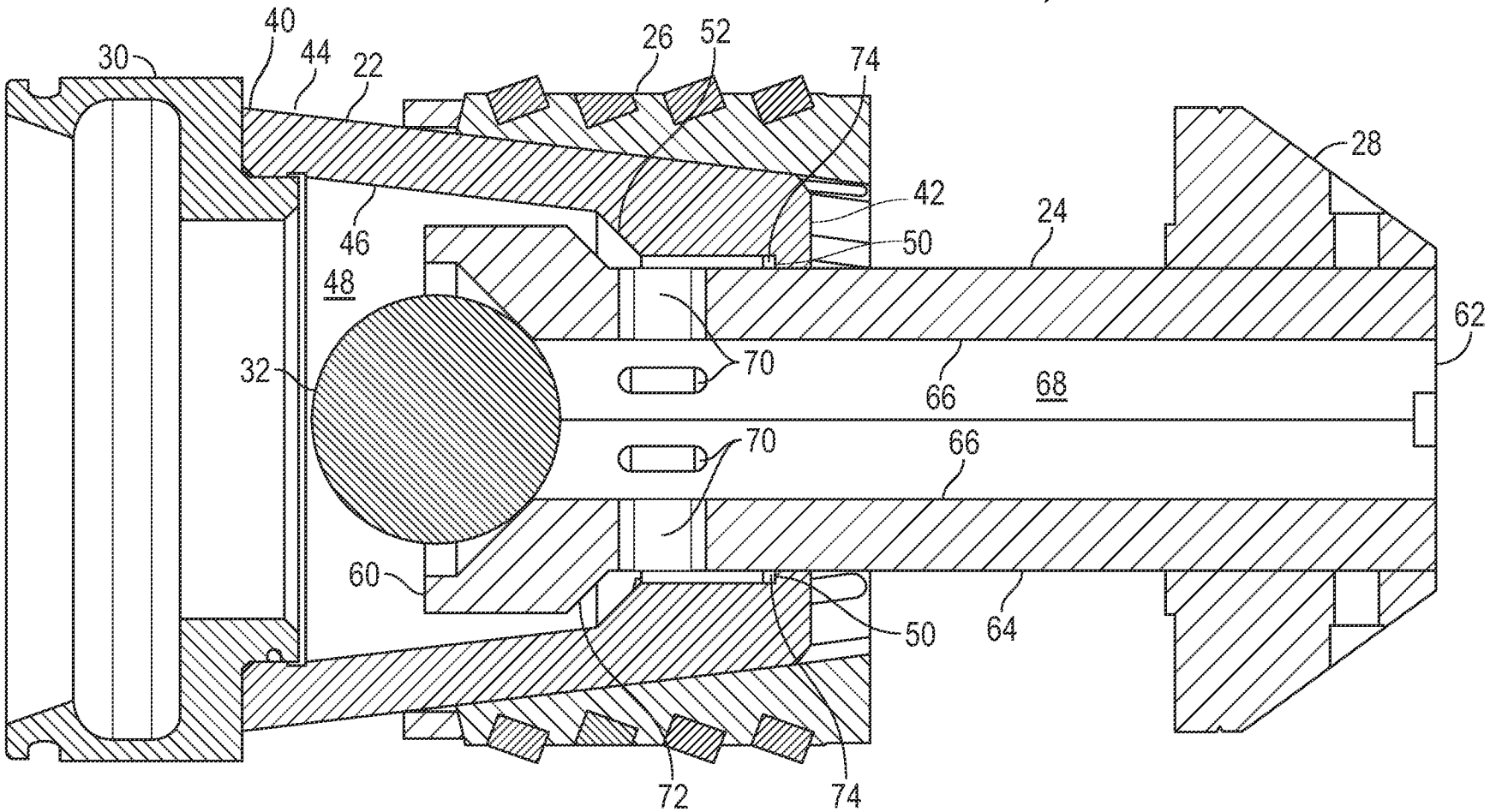
FIG. 3 is a cross-sectional view of the exemplary plug assembly of FIG. 1, in which the plug assembly is in a first state with the tubular mandrel in a first position and a distal end of the tubular mandrel partially removed and the ball seated, in accordance with the present disclosure.
Figure 5:
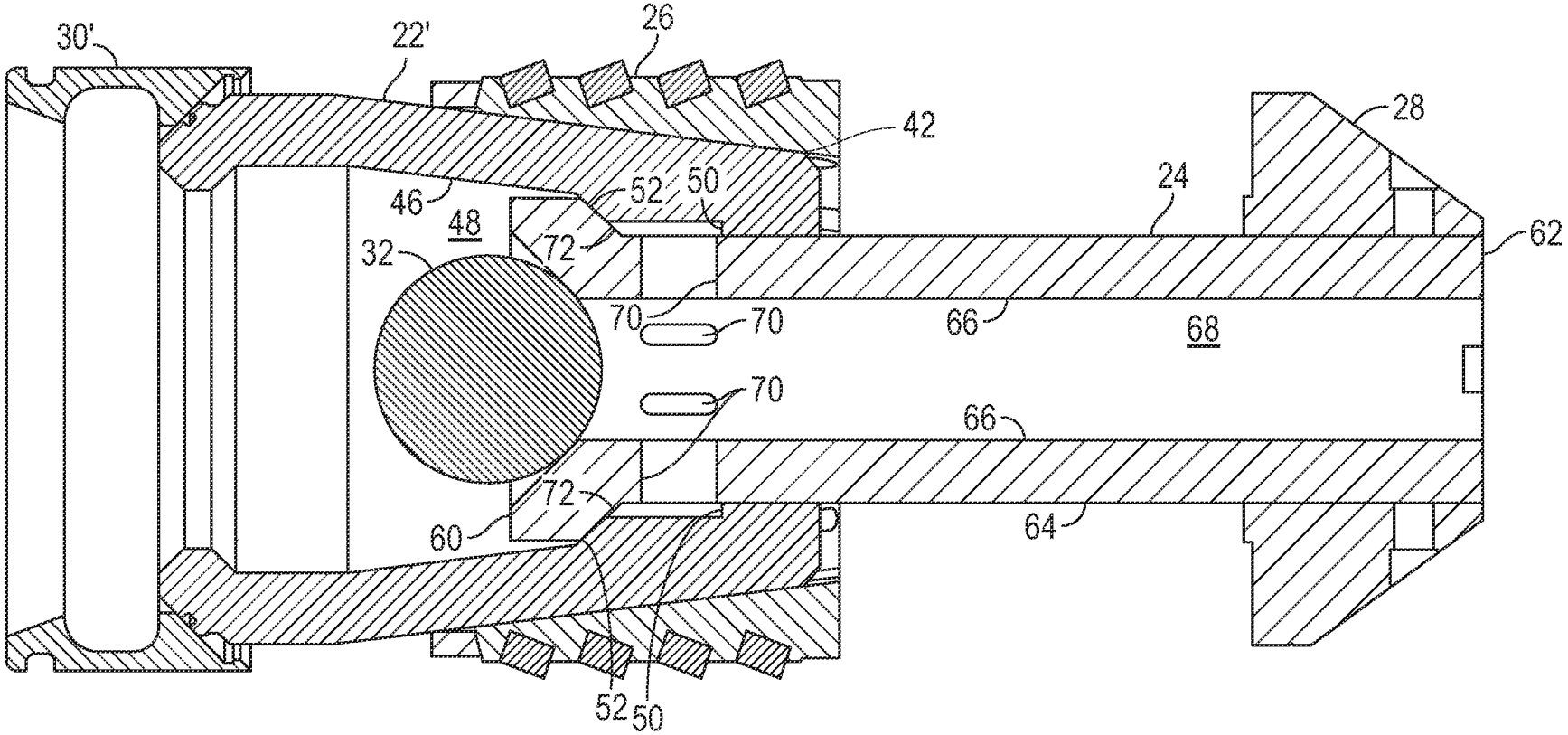
FIG. 5 is a perspective view of the exemplary plug assembly of FIG. 1, in which the plug assembly is in a first state with the mandrel in a second position, in accordance with the present disclosure.
Figure 7:
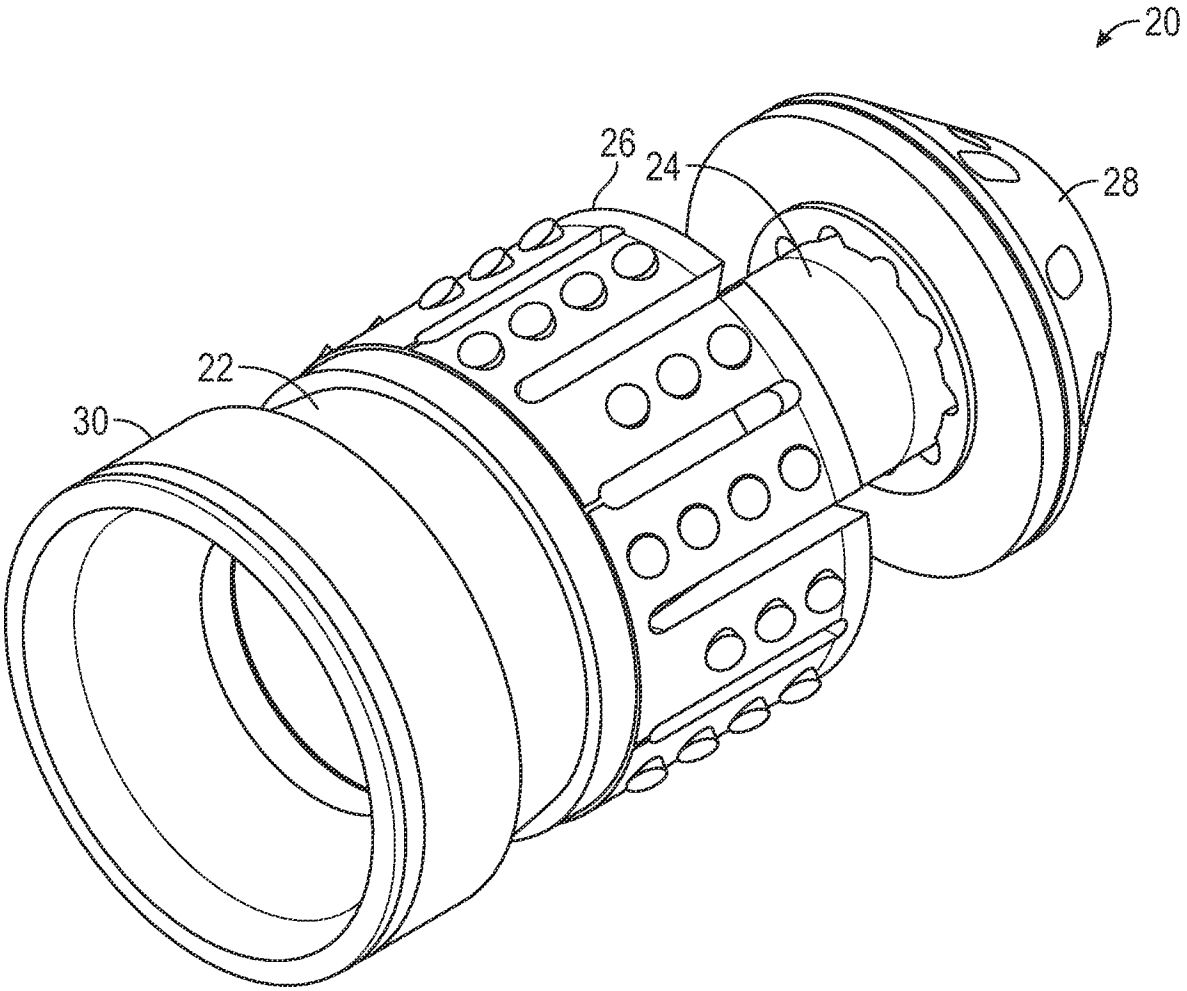
FIG. 7 is a perspective view of the exemplary plug assembly of FIG. 1, in which the plug assembly is in a second state, in accordance with the present disclosure
Figure 8:
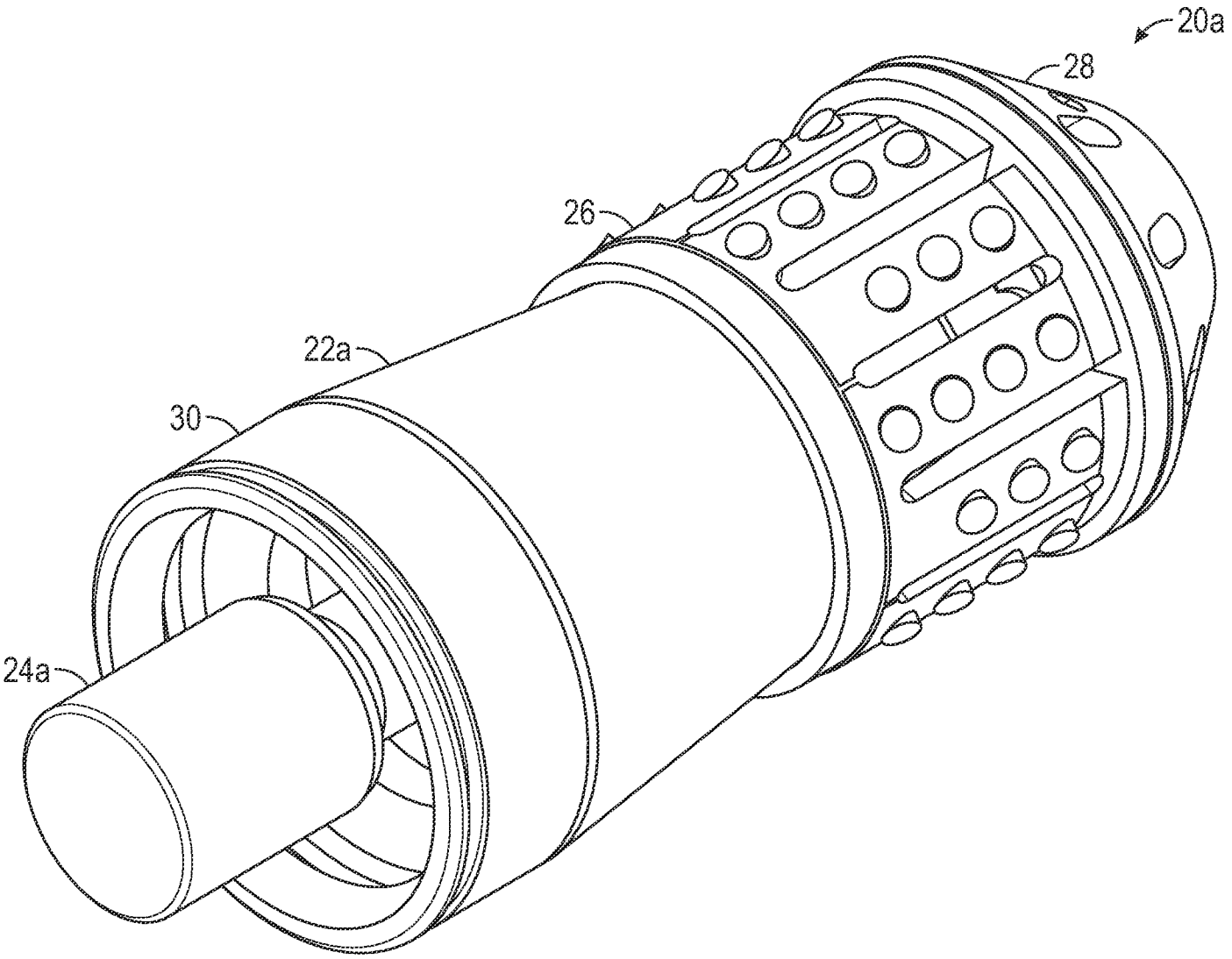
FIG. 8 is a perspective view of another exemplary plug assembly, in which the plug assembly is in an initial state, in accordance with the present disclosure

Referring now to the drawings, and in particular to FIGS. 1 and 2, an exemplary plug assembly 20, such as for use as a frac plug when deployed into a casing 100 within a drilled hole, is shown, in which the plug assembly 20 is in an initial state (in FIG. 2, a ball 32 positioned externally for clarity). FIG. 2A illustrates the plug assembly 20 after the plug assembly 20 is set within the casing 100. FIG. 3 illustrates the plug assembly 20 in a first state, while FIGS. 5 and 7 illustrate the plug assembly 20 in a second state. Further, FIG. 2A is a cross-sectional view of the exemplary plug assembly of FIG. 1 in which a slip member has been set in which the plug assembly is in a first state with a tubular mandrel in a first position with a ball not yet seated within the tubular mandrel; while FIG. 3 is a cross-sectional view of the exemplary plug assembly of FIG. 1, in which the plug assembly is in a first state with the tubular mandrel in a first position and a distal end of the tubular mandrel partially removed and the ball seated, in accordance with the present disclosure.

In some implementations, the plug assembly 20 may comprise a frustoconical tube 22 and a tubular mandrel 24 positioned longitudinally through the frustoconical tube 22. The plug assembly 20 may further comprise a slip member 26, an end cap 28, and/or a seal end 30. The seal end 30 may matingly engage with the frustoconical tube 22, which may matingly engage with the slip member 26, which may matingly engage with end cap 28. In some implementations, the plug assembly 20 may further comprise the ball 32 or other stopper that is configured as a sealing element. In some implementations, as illustrated in FIG. 2A and FIG. 5, the plug assembly 20 may include an alternative seal end 30' in conjunction with an alternative frustoconical tube 22', that share characteristics described herein with the seal end 30 and the frustoconical tube 22, but that may matingly engage with one another differently than the seal end 30 and the frustoconical tube 22 matingly engage.

In some implementations, one or more components, or the entirety, of the plug assembly 20 may be constructed of metal (including one or more metal alloys), plastic, rubber, epoxy, elastomers, resin, glass fiber, composites, and/or combinations thereof. In some implementations, the metal may comprise aluminum, magnesium, steel, copper, tungsten, rare earth elements, pure alloys, aluminum composites, magnesium composites, other composites, and/or combinations thereof.

In some implementations, one or more components, or the entirety, of the plug assembly 20 may be constructed of materials that dissolve in a downhole environment, such as with exposure to downhole fluids, temperatures, pressure, and/or other downhole environmental factors.

As illustrated in FIGS. 2-5, the frustoconical tube 22 has a first end 40, a second end 42, an exterior surface 44, and an interior surface 46. The first end 40 has a first inner diameter and the second end 42 has a second inner diameter smaller than the first inner diameter. The interior surface 46 may be at least partially sloped between the first end 40 and the second end 42. The interior surface 46 defines a tube bore 48 extending longitudinally through the frustoconical tube 22 through the first end 40 and the second end 42.

The interior surface 46 of the frustoconical tube 22 may have a first step 50 between the first end 40 and the second end 42. The first step 50 may be a ridge extending circumferentially (partially or completely) about the tube bore 48. The first step 50 may be proximate to the second end 42 of the frustoconical tube 22. In some implementations, the first step 50 may have an inner diameter equal to the second inner diameter.

The interior surface 46 of the frustoconical tube 22 may have a second step 52 between the first step 50 and the first end 40 of the frustoconical tube 22. The second step 52 may extend circumferentially about the tube bore 48. The second step 52 may be sloped. The second step 52 may be chamfered into the interior surface 46. The second step 52 may have (and/or a slope of the second step 52 may end in) a third diameter that is larger than the second diameter but smaller than the first diameter.

The interior surface 46 of the frustoconical tube 22 may be at least partially sloped between the first end 40 and the first step 50. The interior surface 46 of the frustoconical tube 22 may be at least partially sloped between the first end 40 and the second step 52 of the frustoconical tube 22.

The tubular mandrel 24 may be positioned longitudinally through the tube bore 48 of the frustoconical tube 22. The tubular mandrel 24 has a proximal end 60 positioned proximate to (and/or extending through or initially extending through) the first end 40 of the frustoconical tube 22 and a distal end 62 extending through the second end 42 of the frustoconical tube 22.

The tubular mandrel 24 has an exterior surface 64 and an interior surface 66 defining a mandrel bore 68 longitudinally through the tubular mandrel 24 through the proximal end 60 and the distal end 62. The proximal end 60 of the tubular mandrel 24 may have an outer diameter that is larger than an outer diameter of the distal end 62 of the tubular mandrel 24. The proximal end 60 of the tubular mandrel 24 may have an inner diameter that is larger than an inner diameter of the distal end 62 of the tubular mandrel 24. In other words, the mandrel bore 68 may have a first diameter at the proximal end 60 of the tubular mandrel 24 and a second diameter at the distal end of the tubular mandrel 24, and the first diameter may be larger than the second diameter.

Figure 6:
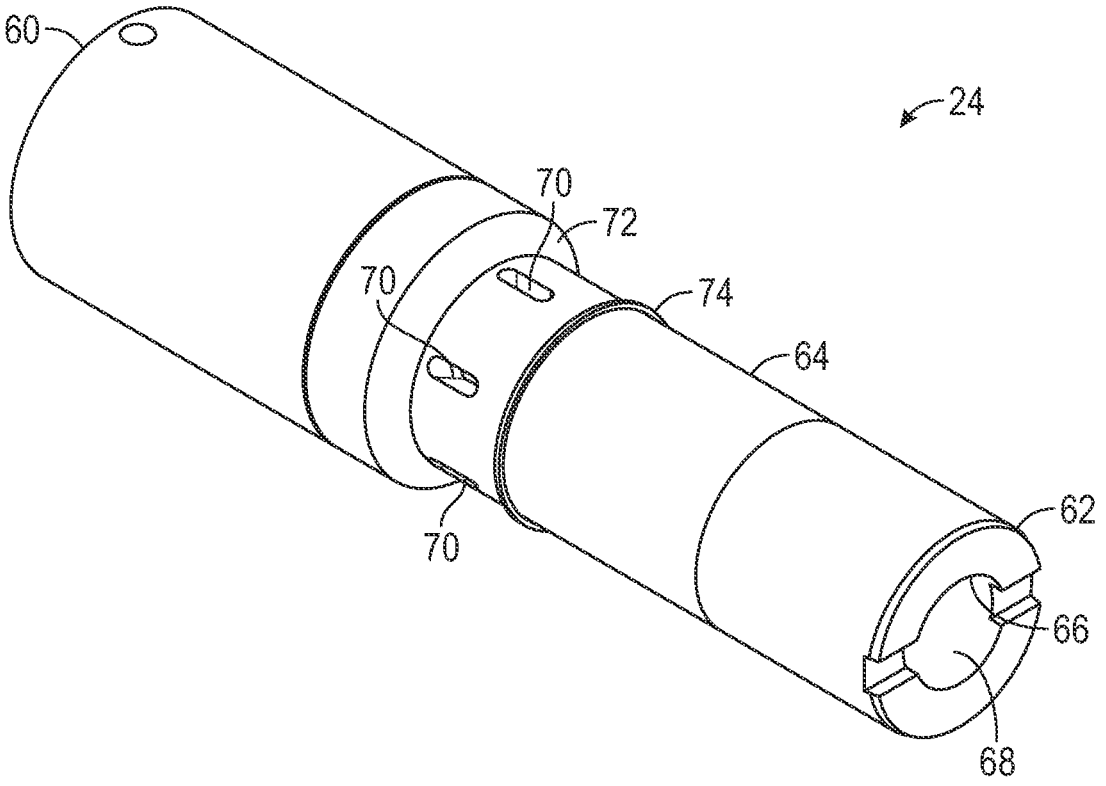
FIG. 6 is a perspective view of an exemplary mandrel of the exemplary plug assembly of FIG. 1.
Figure 6A:
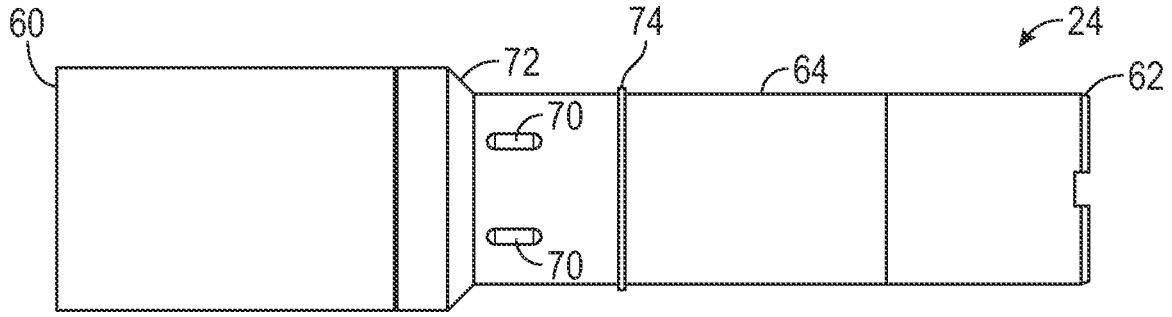
FIG. 6A is a side view of the exemplary mandrel of FIG. 6.

The tubular mandrel 24 may have one or more ports 70 between the proximal end 60 and the distal end 62 fluidly connecting the mandrel bore 68 with the exterior surface 64 and the tube bore 48. The one or more ports 70 may be spaced radially about the tubular mandrel 24 (FIGS. 6 and 6A). In some implementations, the one or more ports 70 may be six ports 70. The one or more ports 70 have a width and may have a longitudinal length longer than the width.

In some implementations, the interior surface 66 of the tubular mandrel 24 may have a circumferential ball seat step 73 between the one or more ports 70 and the proximal end 60. The ball seat step 73 may be sealingly engageable with the ball 32, such that when the ball 32 is engaged with the ball seat step 73, a fluid seal is formed between the proximal end 60 of the tubular mandrel 24 and the distal end 62 of the tubular mandrel 24 that stops fluid flow through the mandrel bore 68. The ball seat step 73 may be sloped or chamfered. In some implementations, the ball seat step 73 may have a first end having the first diameter of the mandrel bore 68 and a second end having the second diameter of the mandrel bore 68.

In some implementations, the exterior surface 64 of the tubular mandrel 24 may have a mandrel step 72 about the circumference of the exterior surface, positioned between the one or more ports 70 and the proximal end 60. The mandrel step 72 may be sloped and/or chamfered in an opposite direction as the second step 52 of the frustoconical tube 22 such that the mandrel step 72 may sealingly engage with the second step 52 when the tubular mandrel 24 is in a second position (FIG. 5). The proximal end 60 of the tubular mandrel 24 may have an outer diameter that is larger than an outer diameter of the distal end 62 of the tubular mandrel 24.

As illustrated in FIGS. 6 and 6A, the tubular mandrel 24 may have one or more shear ring 74 extending from the exterior surface 64. The one or more shear ring 74 may be positioned between the one or more ports 70 and the distal end 62. The one or more shear ring 74 may be positioned between the one or more ports 70 and the proximal end 60. The shear ring 74 may extend circumferentially (partially or completely) about the exterior surface 64 of the tubular mandrel 24. The shear ring 74 may be configured to shear off of the exterior surface 64 when a predetermined force is applied to the shear ring 74.

Figure 4:
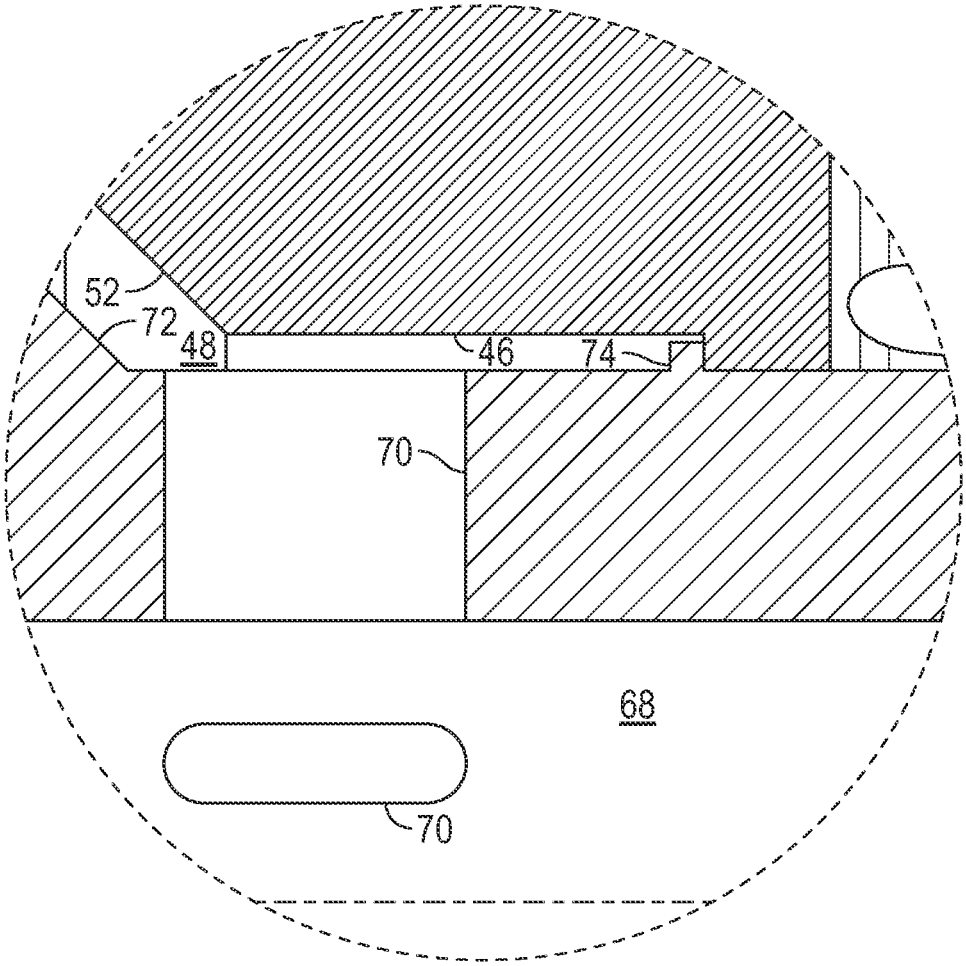
FIG. 4 is a cross-sectional view of a portion of the plug assembly of FIG. 1.

As shown in FIGS. 2-4, the shear ring 74 may have an outer diameter that is greater than the inner diameter of the first step 50, such that the first step 50 acts as a stop against the shear ring 74, stopping longitudinal movement of the tubular mandrel 24 through the tube bore 48 of the frustoconical tube 22, until the shear ring 74 is sheared away under a predetermined pressure. The shear ring 74 may have an outer diameter that is less than the inner diameter of the first end 40 of the frustoconical tube 22. The shear ring 74 may have an outer diameter that is less than the inner diameter of the second step 52 of the frustoconical tube 22.

The ball 32 may be positionable at least partially in the mandrel bore 68 of the tubular mandrel 24 at the proximal end 60 and may be configured to fluidly seal the tube bore 48 in the proximal end 60 of the tubular mandrel 24 at a first predetermined flow rate and/or predetermined fluid pressure. The ball 32 may fluidly seal the tube bore 48 by sealingly engaging with the ball seat step 73.

The tubular mandrel 24 may be configured to move between one or more first position(s) (FIGS. 2-4) and a second position (FIG. 5) in the frustoconical tube 22. In the first position, the tubular mandrel 24 may be positioned relative to the frustoconical tube 22 such that the shear ring 74 is between the first step 50 of the frustoconical tube 22 and the first end 40 of the frustoconical tube 22, such that a fluid passageway is formed between the exterior surface 64 of the tubular mandrel 24 and the tube bore 48 of the frustoconical tube 22, through the one or more ports 70 of the tubular mandrel 24, and through the distal end 62 of the tubular mandrel 24. The shear ring 74 may be in contact with an interior face of the first step 50 of the frustoconical tube 22.

The fluid passageway may allow fluid to flow through the plug assembly 20 before and after the ball 32 is seated, until a second predetermined flow rate and/or predetermined fluid pressure is applied.

The plug assembly 20 may have a second state in which the tubular mandrel 24 is in the second position. The plug assembly 20 moves to the second state when at least the second flow rate and/or predetermined fluid pressure is applied to the plug assembly 20. When the second flow rate and/or predetermined fluid pressure is reached, a pressure differential may be created between the pressure on the proximate end 60 and the distal end 62 of the tubular mandrel 24. In some implementations, the magnitude of the pressure differential may be approximately proportional to the square of the magnitude of the flow rate passing through the fluid passageway through the tubular mandrel 24. At a predetermined flow rate, the pressure differential creates a force that pushes the shear ring 74 against the first step 50 of the frustoconical tube 22 and shears the shear ring 74 from the exterior surface 64 of the tubular mandrel 24.

Then the fluid pressure may move the tubular mandrel 24 longitudinally within the tube bore 48 to the second position, such that the exterior surface 64 of the tubular mandrel 24 sealingly engages the interior surface 46 of the frustoconical tube 22, thereby blocking the one or more ports 70 and/or the fluid passageway and stopping fluid flow through the plug assembly 20. In some implementations, the fluid pressure may then move the tubular mandrel 24 longitudinally within the tube bore 48 such that the mandrel step 72 of the exterior surface 64 of the tubular mandrel 24 sealingly engages the second step 52 of the frustoconical tube 22, thereby blocking the one or more ports 70 and/or the fluid passageway and stopping fluid flow through the plug assembly 20.

In some implementations, the second predetermined flow rate may be at least fifteen barrels per minute.

In some implementations, the slip member 26 may have one or more slip segments 80. The slip member 26 may positioned at least partially circumferentially about the second end 42 of the frustoconical tube 22 such that the slip segments 80 are pushed outwardly when the second end 42 of the frustoconical tube moves longitudinally. The slip member 26 may have a sloped interior surface 82 configured to engage the second end 42 of the exterior surface 44 of the frustoconical tube 22. In some implementations, the slip member 26 may be plastic, metal, or a combination thereof. In some implementations, the slip segments 80 of the slip member 26 may optionally have one or more grips 84 protruding externally from and/or through the slip segments 80. Nonexclusive examples of the grips 84 include, teeth, buttons, and ridges. In some implementations, the grips 84 may be cylindrical and may have longitudinal axes set at an angle to the longitudinal axis of the plug assembly 20.

In some implementations, the end cap 28 may be in contact with the distal end 62 of the tubular mandrel 24. The end cap 28 may initially be in contact with the slip member 26, before the slip member 26 engages the second end 42 of the exterior surface 44 of the frustoconical tube 22.

The seal end 30 may be a tubular member in contact with the second end of the frustoconical tube 22. The seal end 30 may act as an additional securing component for securing the plug assembly 20 within the casing 100, and/or the seal end 30 may act as a seal or include an elastomer seal, to seal fluid flow from moving around the exterior surface 44 of the frustoconical tube 22. In some implementations, the plug assembly 20 may further comprise an elastomer seal positioned radially on the exterior of the seal end 30. The elastomer seal may be an O-ring or other gasket, for example. In some implementations, the exterior of the seal end 30 may include a radial groove around its exterior and the elastomer seal may be seated at least partially in the radial groove. The seal end 30 may be in contact with a setting tool 90 while the plug assembly 20 is set within the casing 100.

Figure 15:
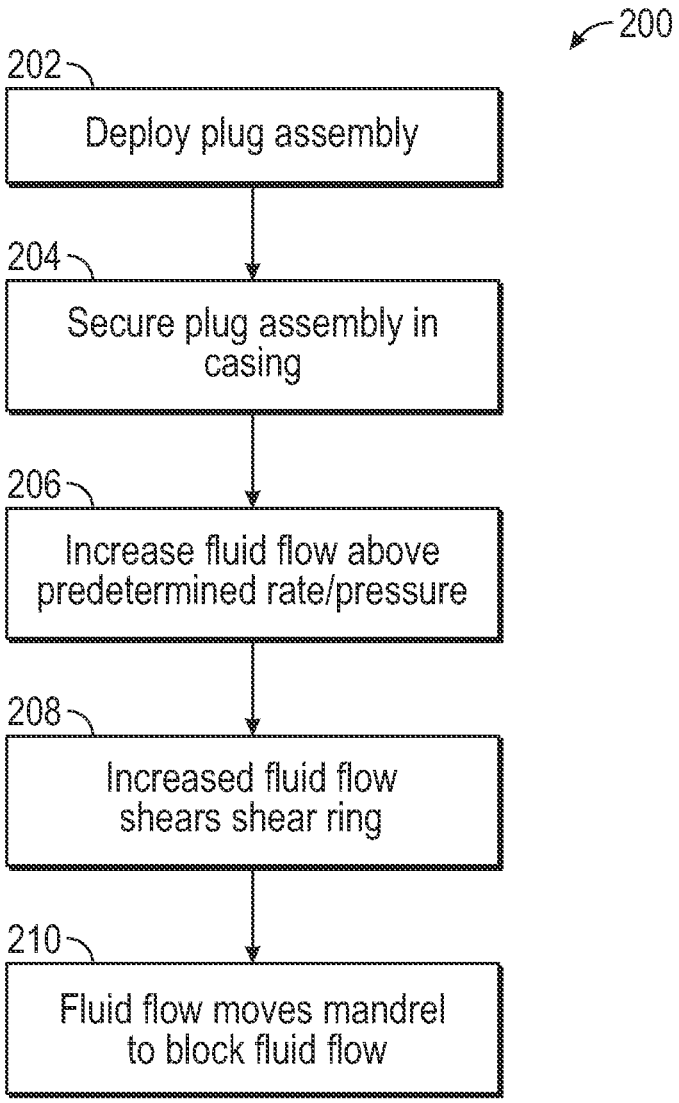
FIG. 15 is a process flow diagram of an exemplary method in accordance with the present disclosure.
Figure 16:
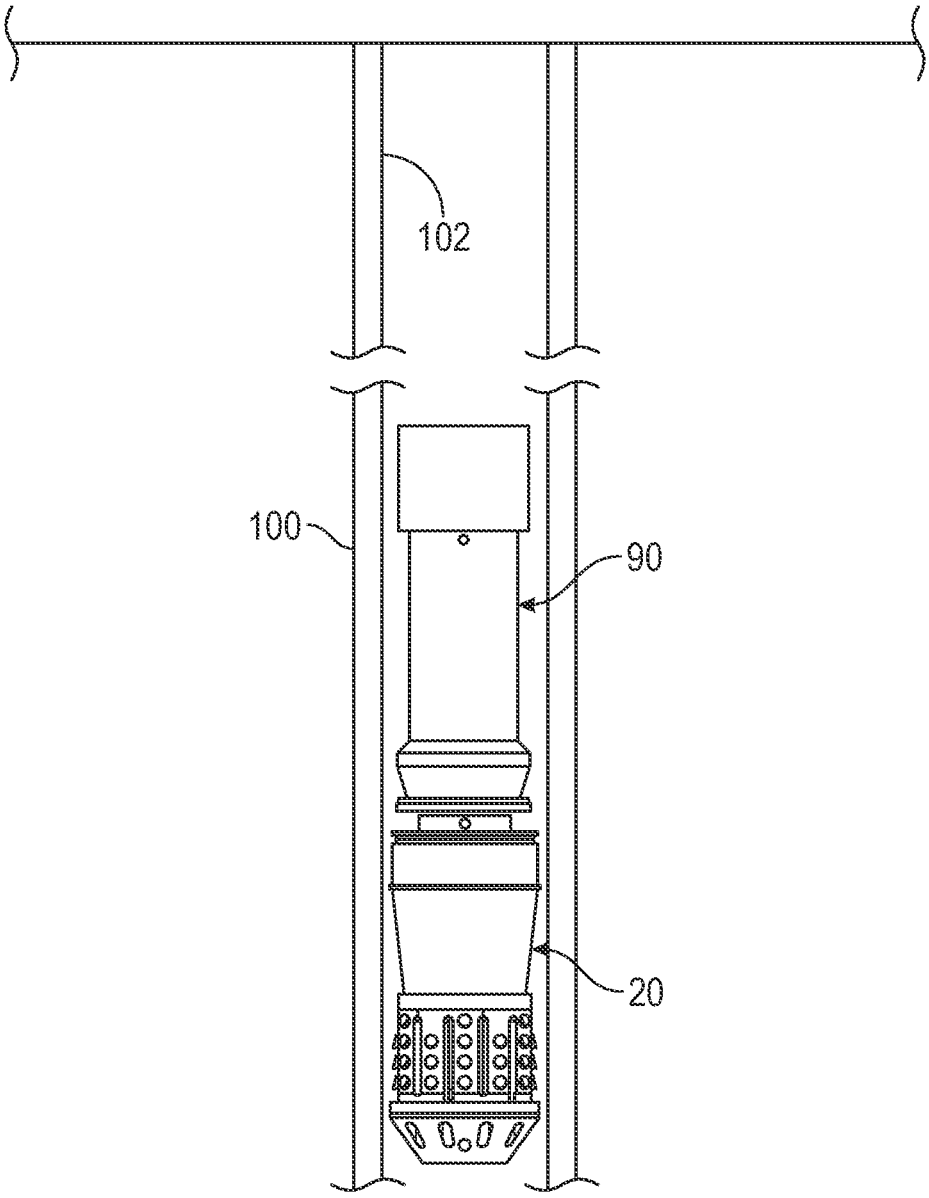
FIG. 16 is a side view of the exemplary plug assembly of FIG. 1 and an exemplary setting tool deployed in a downhole casing in accordance with the present disclosure.
Figure 17:
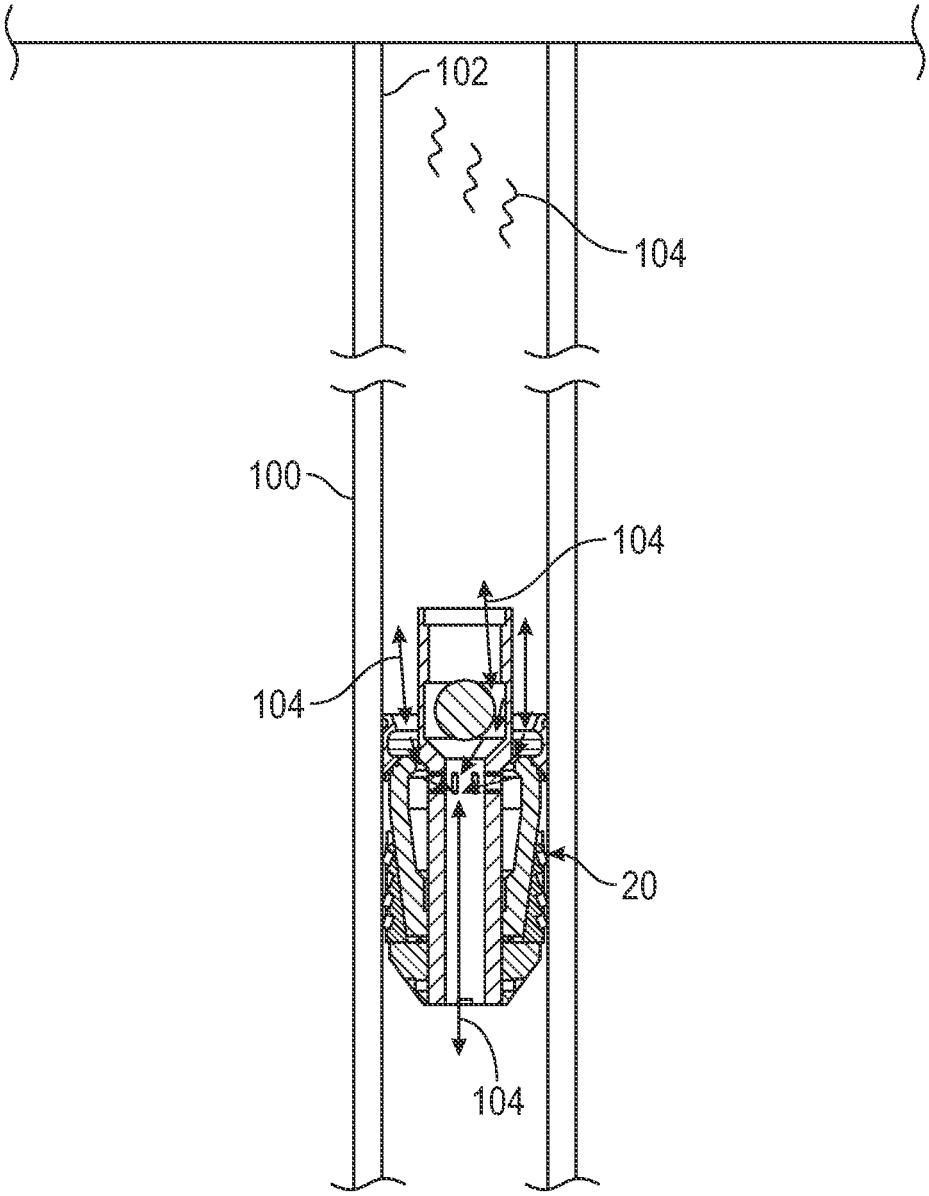
FIG. 17 is a cross-sectional view of the exemplary plug assembly of FIG. 1 set with the setting tool with a mandrel in a first position in a downhole casing in accordance with the present disclosure.

A method 200 of use of the plug assembly 20 will now be described, as illustrated in FIGS. 15-19. In one implementation, the method 200 may include a step 202 of deploying the plug assembly 20 (as depicted in FIGS. 1 and 2) and the setting tool 90 into the casing 100 within a drilled wellbore (FIG. 16). A step 204 may comprise securing the plug assembly 20 in the casing 100 by introducing a first fluid flow 104 into the casing 100 to longitudinally move the frustoconical tube 22 with the setting tool 90, thereby expanding the slip segments 80 of the slip member 26 (FIG. 2A) and coupling the plug assembly 20 to an interior 102 of the casing 100 with the slip segments 80 (FIG. 17). The setting tool 90 may be removed from the casing after the plug assembly 20 is set in the casing.

At this point, the plug assembly 20 may be in the first state and the tubular mandrel 24 of the plug assembly 20 may be in the first position relative to the frustoconical tube 22 such that the shear ring 74 is positioned between the one or more ports 70 and the first step 50. In some implementations, the shear ring 74 contacts the first step 50 and/or the interior surface 46 of the frustoconical tube 22 between the first step 50 of the frustoconical tube 22 and the first end 40 of the frustoconical tube 22 (FIG. 4). The fluid passageway is formed between the exterior surface 64 of the tubular mandrel 24 and the interior surface 46 of the frustoconical tube 22 within the tube bore 48, through the one or more ports 70 of the tubular mandrel 24, and through the distal end 62 of the tubular mandrel 24 through the mandrel bore 68.

Figure 18:
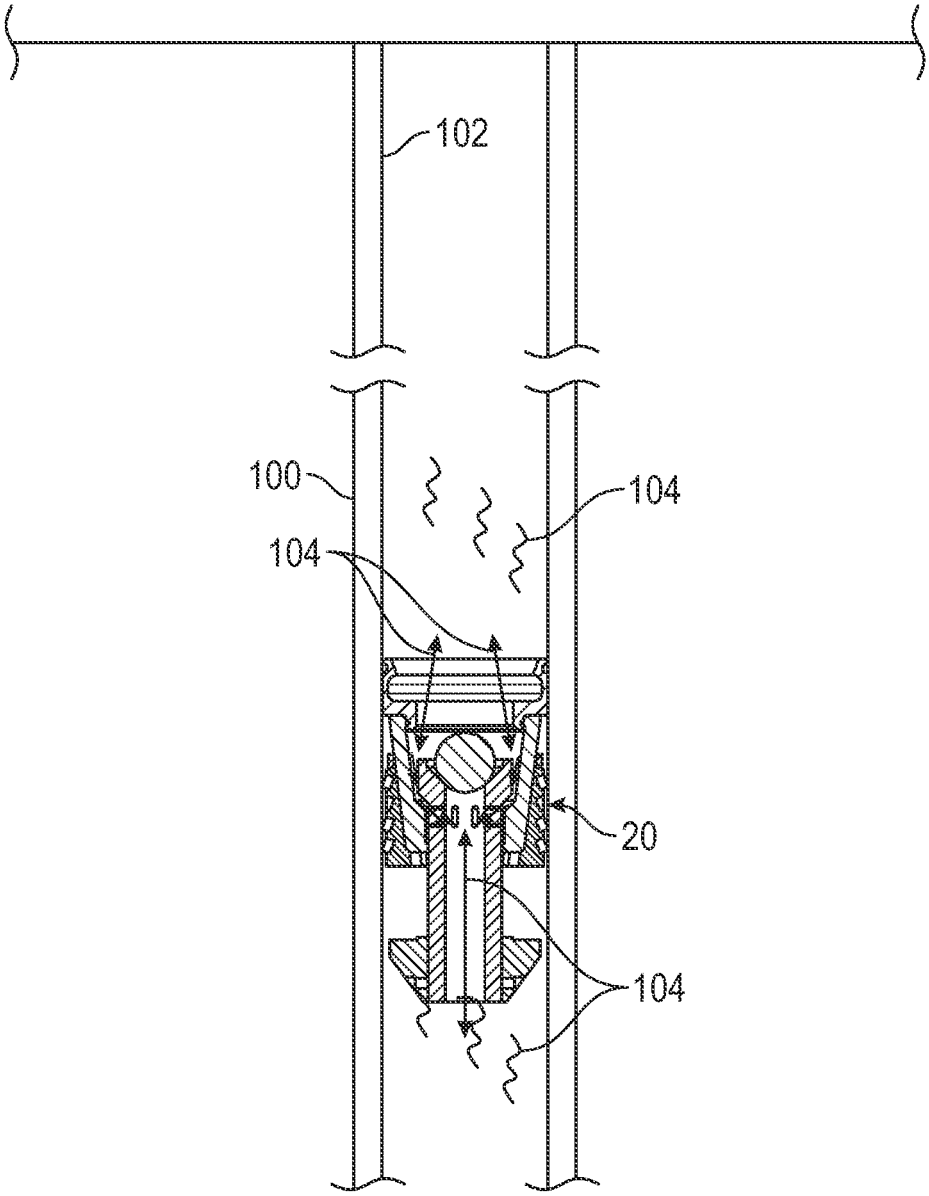
FIG. 18 is a cross-sectional view of the exemplary plug assembly of FIG. 1 with a mandrel in a first position in a downhole casing in accordance with the present disclosure.

Additionally, in some implementations, initially the first fluid flow 104 may flow straight through the mandrel bore 68, and may also through the fluid passageway (that is, between the exterior surface 64 of the tubular mandrel 24 and the interior surface 46 of the frustoconical tube 22 within the tube bore 48, through the one or more ports 70 of the tubular mandrel 24, and through the distal end 62 of the tubular mandrel 24 through the mandrel bore 68, until the ball 32 is seated in the proximate end 60 of the tubular mandrel 24 by the first fluid flow (FIG. 17). Once the ball 32 is seated (FIG. 3), fluid flow through the plug assembly 20 is only through the fluid passageway (FIG. 18). The tubular mandrel 24 may be moved further through the frustoconical tube 22 to create or partially create the fluid passageway.

In some implementations, a portion of the proximal end 60 of the tubular mandrel 24 may be removed (FIG. 3).

In step 206, the fluid flow may be increased to above a second predetermined flow rate and/or second predetermined fluid pressure. In step 208, when the second flow rate and/or predetermined fluid pressure is reached, a pressure differential may be created between the pressure on the proximate end 60 and the distal end 62 of the tubular mandrel 24. In some implementations, the magnitude of the pressure differential may be approximately proportional to the square of the magnitude of the flow rate passing through the fluid passageway. At a predetermined flow rate, the pressure differential may create a force that pushes the shear ring 74 against the first step 50 of the frustoconical tube 22 and shears the shear ring 74 from the exterior surface 64 of the tubular mandrel 24.

Figure 19:
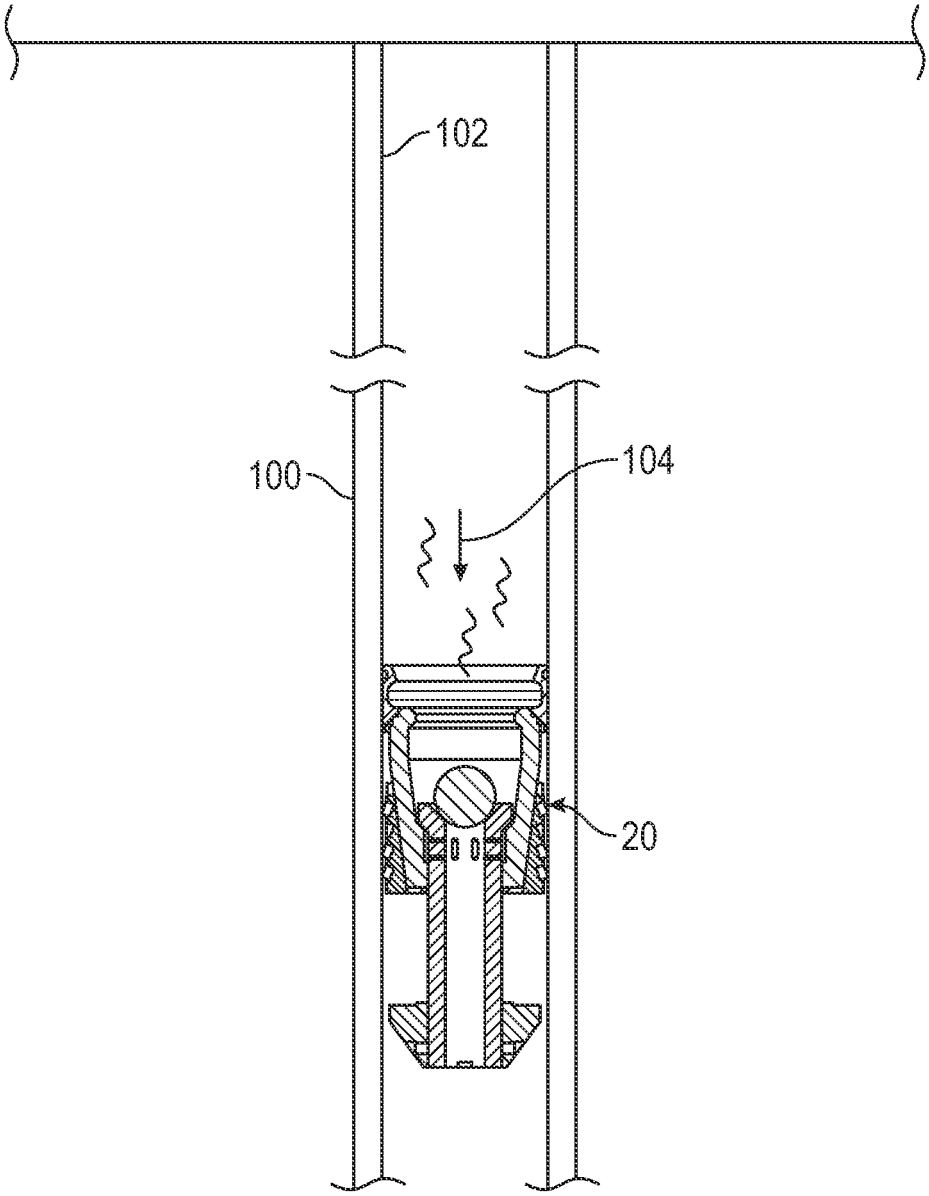
FIG. 19 is a cross-sectional view of the exemplary plug assembly of FIG. 1 with a mandrel in a second position in a downhole casing in accordance with the present disclosure.

In step 210, after the shear ring 74 is removed in step 208, the fluid flow/pressure may move the tubular mandrel 24 longitudinally within the tube bore 48 to the second position such that the exterior surface 64 of the tubular mandrel 24 sealingly engages the interior surface 46 of the frustoconical tube 22, thereby blocking the one or more ports 70 and/or the fluid passageway and stopping fluid flow through the plug assembly 20 (FIG. 5 and FIG. 19). In some implementations, step 210 further comprises that the fluid pressure may move the tubular mandrel 24 longitudinally within the tube bore 48 such that the mandrel step 72 of the exterior surface 64 of the tubular mandrel 24 sealingly engages the second step 52 of the frustoconical tube 22, thereby blocking the one or more ports 70 and/or the fluid passageway and stopping fluid flow through the plug assembly 20.

In some implementations, the second predetermined flow rate may be at least fifteen barrels per minute.

FIGS. 8-10A illustrate another embodiment of a plug assembly 20*a*. The plug assembly 20*a* may comprise a frustoconical tube 22*a*; a mandrel 24*a* positioned longitudinally through the frustoconical tube 22*a*; and a ported ring 133 positioned circumferentially about the mandrel 24*a* within the frustoconical tube 22*a*. The plug assembly 20*a* may further comprise the slip member 26, the end cap 28, and/or the seal end 30 as previously described in relation to the plug assembly 20.

In some implementations, one or more components, or the entirety, of the plug assembly 20*a* may be constructed of metal (including one or more metal alloys), plastic, rubber, epoxy, elastomers, resin, glass fiber, composites, and/or combinations thereof. In some implementations, the metal may comprise aluminum, magnesium, steel, copper, tungsten, rare earth elements, pure alloys, aluminum composites, magnesium composites, and/or combinations thereof.

In some implementations, one or more components, or the entirety, of the plug assembly 20*a* may be constructed of materials that dissolve in a downhole environment, such as with exposure to downhole fluids, temperatures, pressure, and/or other downhole environmental factors.

Figure 9:
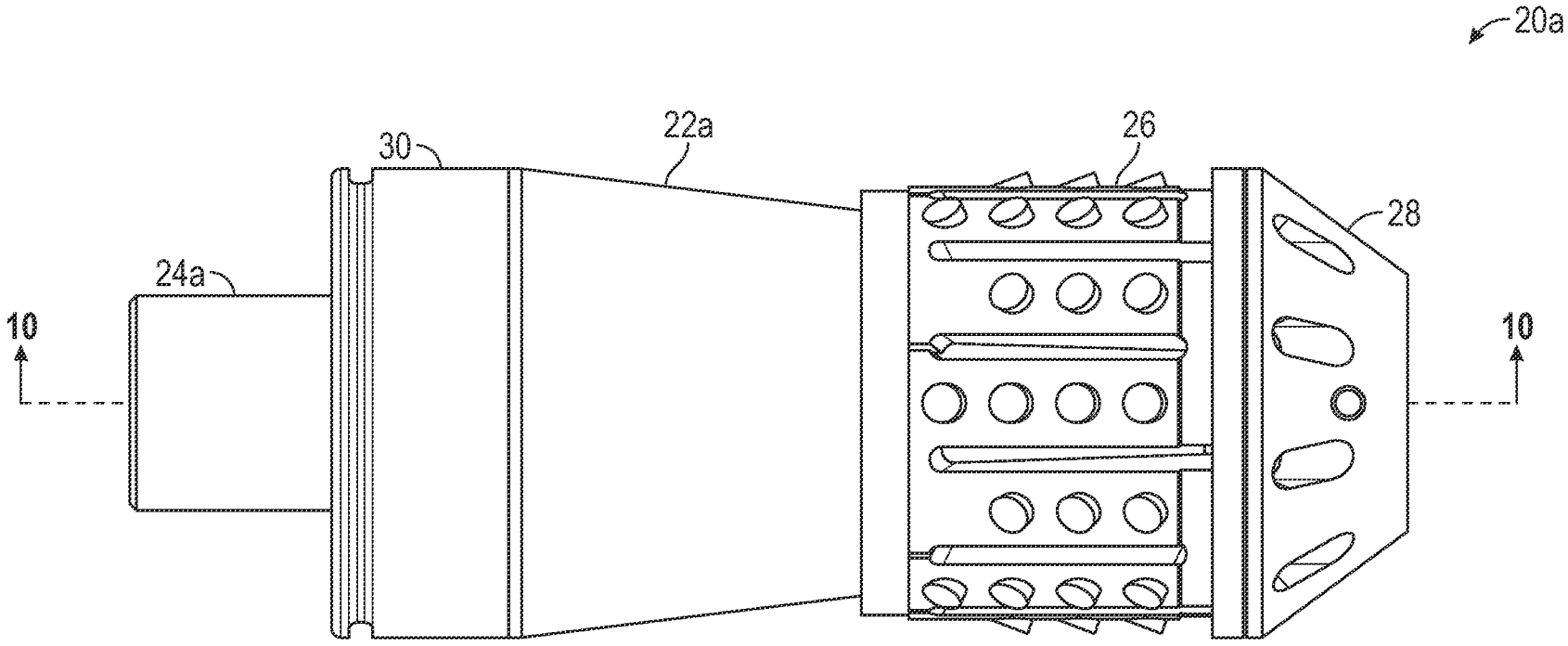
FIG. 9 is a side view of the exemplary plug assembly of FIG. 8.
Figure 10:
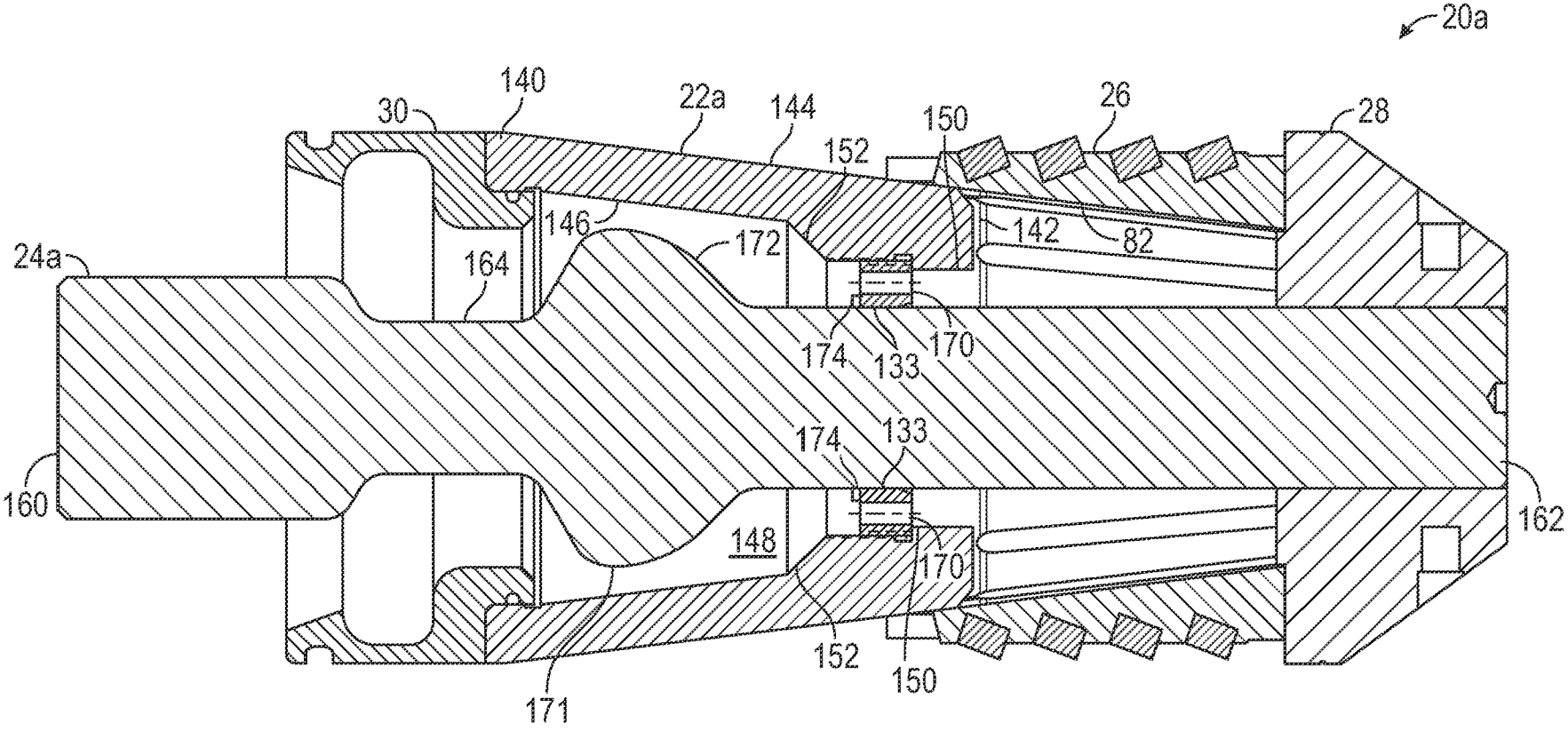
FIG. 10 is a cross-sectional view of the exemplary plug assembly of FIG. 8.

As illustrated in FIGS. 9 and 10, the frustoconical tube 22*a* has a first end 140, a second end 142, an exterior surface 144, and an interior surface 146. The first end 140 has a first inner diameter and the second end 142 has a second inner diameter smaller than the first inner diameter. The interior surface 146 may be at least partially sloped between the first end 40 and the second end 142. The interior surface 146 defines a tube bore 148 extending longitudinally through the frustoconical tube 22*a* through the first end 140 and the second end 142.

The interior surface 146 of the frustoconical tube 22*a* may have a first step 150 between the first end 140 and the second end 142. The first step 150 may be a ridge extending circumferentially (partially or completely) about the tube bore 148. The first step 150 may be proximate to the second end 142 of the frustoconical tube 22*a*. The first step 150 may have an inner diameter equal to the second inner diameter of the second end 142 of the frustoconical tube 22*a*.

The interior surface 146 of the frustoconical tube 22*a* may have a second step 152 between the first step 150 and the first end 140 of the frustoconical tube 22*a*. The second step 152 may extend circumferentially about the tube bore 148. The second step 152 may be sloped. The second step 152 may be chamfered into the interior surface 146. The second step 52 may have (and/or a slope of the second step 152 may end in) an inner diameter that is a third diameter that is larger than the second diameter but smaller than the first diameter of the frustoconical tube 22*a*.

The interior surface 146 of the frustoconical tube 22*a* may be at least partially sloped between the first end 140 and the first step 150. The interior surface 146 of the frustoconical tube 22*a* may be at least partially sloped between the first end 140 and the second step 152 of the frustoconical tube 22*a*.

The mandrel 24*a* may be positioned longitudinally through the tube bore 148 of the frustoconical tube 22*a*. The mandrel 24*a* has a proximal end 160 positioned proximate to (and/or extending through or initially extending through) the first end 140 of the frustoconical tube 22*a* and a distal end 162 extending through the second end 142 of the frustoconical tube 22*a*. The distal end 162 has a first diameter. The mandrel 24*a* has an exterior surface 164.

Figure 10A:
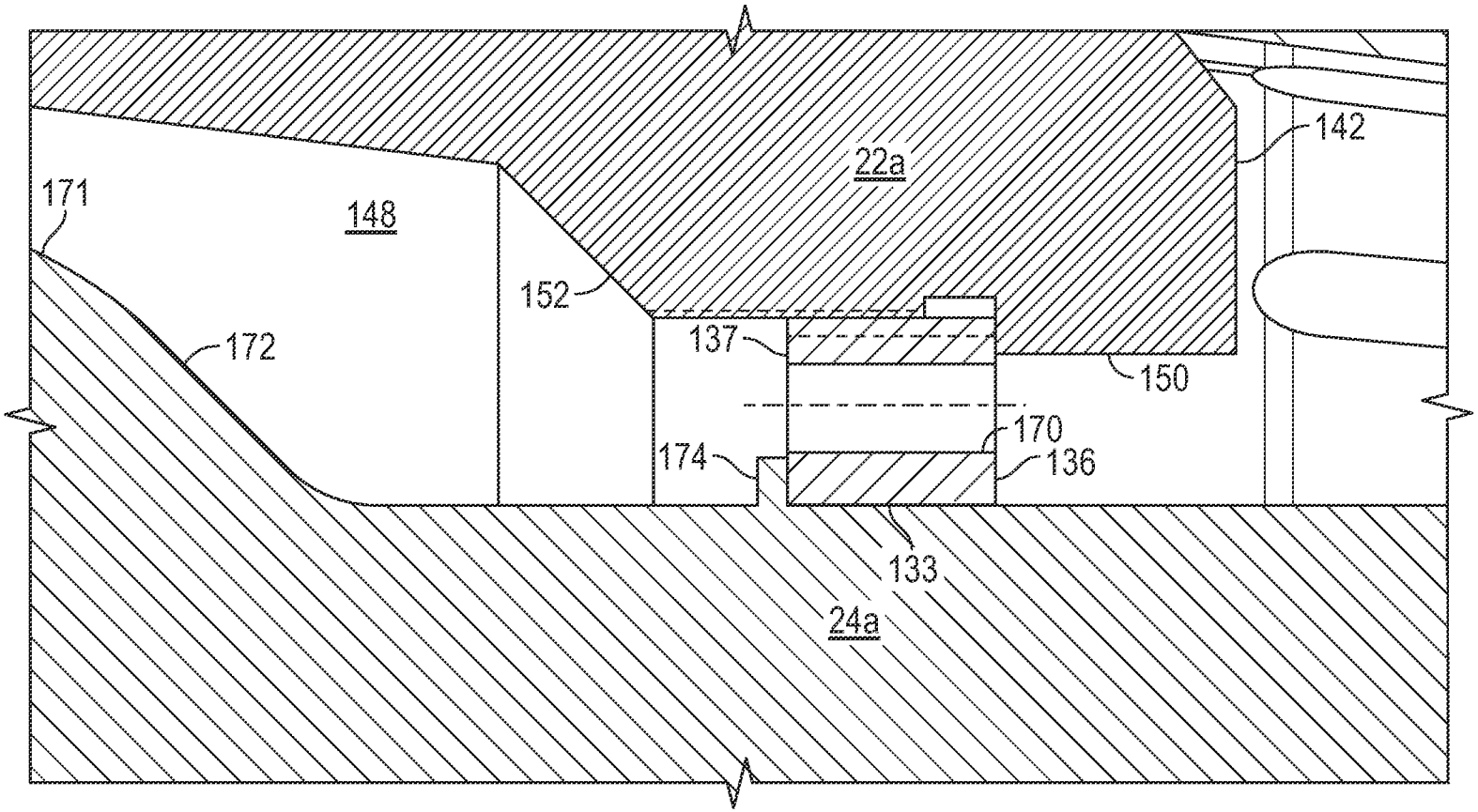
FIG. 10A is a cross-sectional view of a portion of the plug assembly of FIG. 10.
Figure 11:
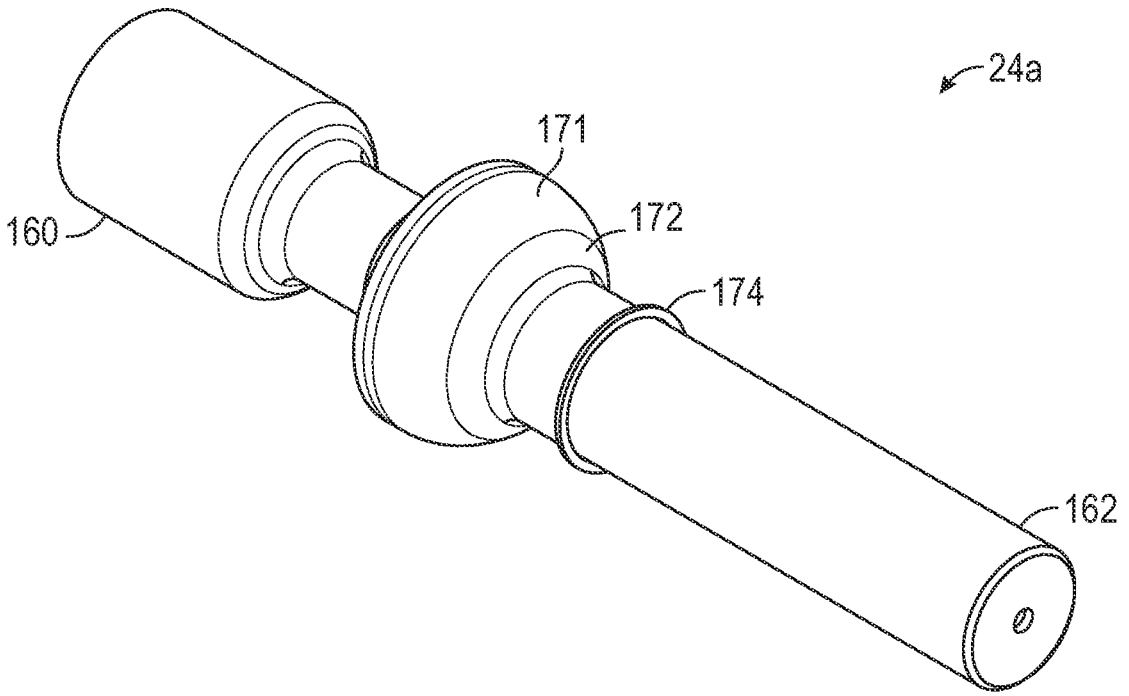
FIG. 11 is a perspective view of an exemplary mandrel of the exemplary plug assembly of FIG. 8, in accordance with the present disclosure.
Figure 11A:
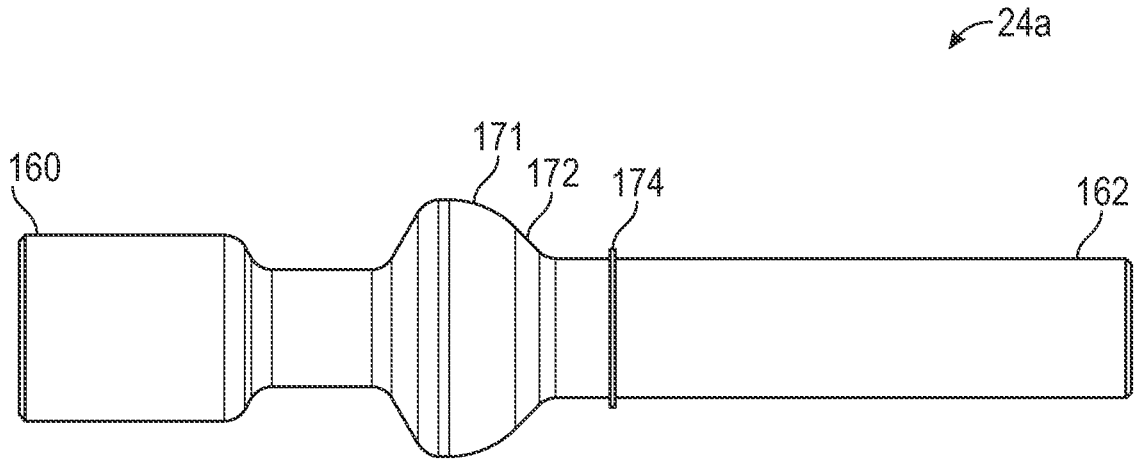
FIG. 11A is a side view of the exemplary mandrel of FIG. 11.

As illustrated in FIGS. 10 and 10A, the mandrel 24*a* may have a seating segment 171 between the proximal end 160 and the distal end 162 of the mandrel 24*a*. The seating segment 171 may have a second diameter greater than the first diameter of the distal end 162 of the mandrel 24*a*. The seating segment 171 may have a chamfered edge 172. In some implementations, the chamfered edge 172 may have a slope matching, but at an opposite angle to, the slope of the second step 152 of the frustoconical tube 22*a*. The seating segment 171 may be configured to sealingly engage with the second step 152 of the frustoconical tube 22*a* when the mandrel 24*a* is in a second position, such that fluid is stopped from flowing between the exterior surface 164 of the mandrel 24*a* and the interior surface 146 of the frustoconical tube 22*a*.

The mandrel 24*a* may have one or more shear ring 174 extending from the exterior surface 164 and positioned between the seating segment 171 and the distal end 162 of the mandrel 24*a* (FIGS. 10, 10A, 11, and 11A). The shear ring 174 may extend (partially or completely) circumferentially about the exterior surface 164 of the mandrel 24*a*. The shear ring 174 may be configured to shear off of the exterior surface 164 when a predetermined force is applied to the shear ring 174. The shear ring 174 may abut and/or engage the ported ring 133, such that the ported ring 133, when positioned against the first step 150, acts as a stop against the shear ring 174, stopping longitudinal movement of the mandrel 24*a* through the tube bore 148 of the frustoconical tube 22*a*, until the shear ring 174 and/or the ported ring 133 is sheared away under a predetermined pressure. The shear ring 174 may have an outer diameter that is less than the inner diameter of the first end 140 of the frustoconical tube 22*a*. The shear ring 174 may have an outer diameter that is less than the inner diameter of the second step 152 of the frustoconical tube 22*a*.

Figure 12:
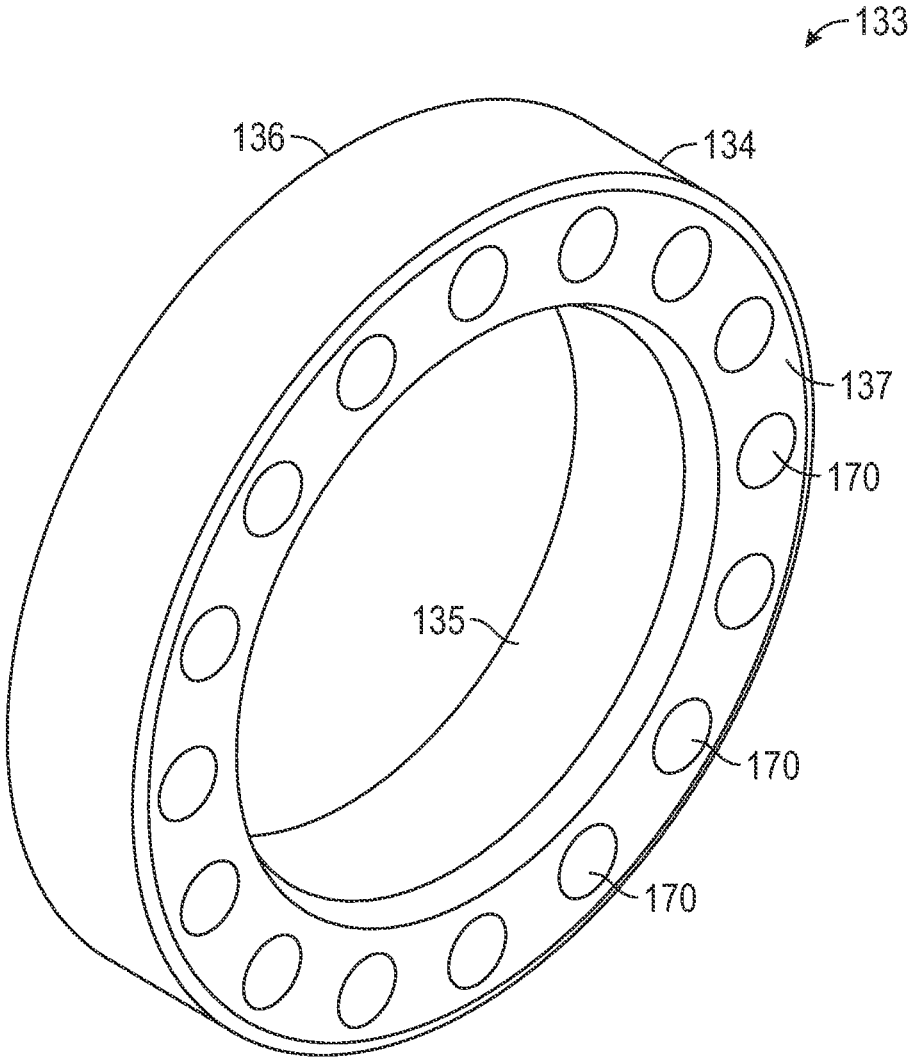
FIG. 12 is a perspective view of an exemplary ported ring of the exemplary plug assembly of FIG. 8, in accordance with the present disclosure.

As illustrated in FIG. 12, the ported ring 133 has an exterior surface 134, an interior surface 135, a first side 136, a second side 137, a thickness extending between the first side 136 and the second side 137, and one or more ports 170 extending longitudinally through the thickness and through the first side 136 and the second side 137. In some implementations, the one or more ports 16 may be sixteen ports. For clarity, not all of the ports 170 are labeled in FIG. 12. The one or more ports 170 may be positioned in the ported ring 133 such that the shear ring 174 does not block fluid flow through the one or more ports 170 when the ported ring 133 is positioned about the mandrel 24*a*. Further, in some implementations, the shear ring 174 may have a height (extending from the exterior surface 164 of the mandrel 24*a*) that is less than a distance from the interior surface 135 to the one or more ports 170.

The ported ring 133 may be positioned circumferentially about the mandrel 24*a* between the shear ring 174 and the distal end 162. The interior surface 135 may be in contact with at least a portion of the exterior surface 164 of the mandrel 24*a*. The exterior surface 134 may be in contact with the interior surface 146 of the frustoconical tube 22*a*. The second side 137 may be in contact with the first step 150 of the frustoconical tube 22*a*, without blocking the one or more ports 170. The first step 150 may have a depth that is less than a distance from the exterior surface 134 of the ported ring 133 to the one or more ports 170. The position of the ported ring 133 initially creates a fluid passageway between the interior surface 146 of the frustoconical tube 22*a* in the tube bore 148 and the exterior surface 164 of the mandrel 24*a* and through the one or more ports 170 of the ported ring 133, when the mandrel 24*a* is in a first position.

Figure 13:
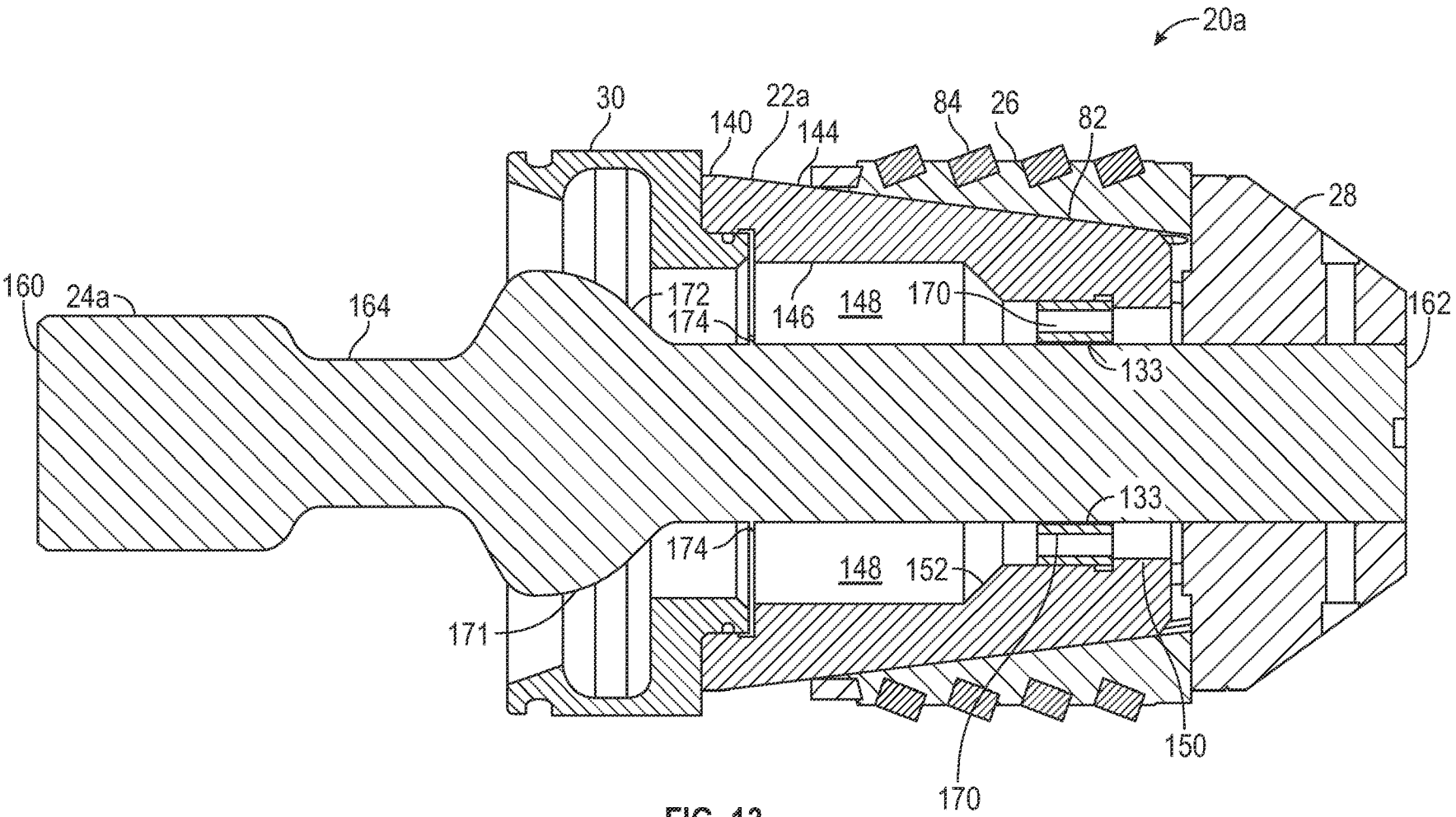
FIG. 13 is a cross-sectional view of the exemplary plug assembly of FIG. 8 in a first state, in accordance with the present disclosure.

The mandrel 24*a* may be configured to move between a first position (FIGS. 10, 10A, 13) and a second position (FIG. 14) in the frustoconical tube 22*a*. In the first position, the mandrel 24*a* may be positioned relative to the frustoconical tube 22*a* such that the shear ring 74 is positioned between the first step 150 of the frustoconical tube 22*a* and the first end 140 of the frustoconical tube 122 and such that the chamfered edge 172 of the seating segment 171 is positioned at a longitudinal offset from the second step 152 of the frustoconical tube 22*a*, such that a fluid passageway is formed between the exterior surface 164 of the mandrel 24*a* and the interior surface 146 of the frustoconical tube 22*a* within the tube bore 48 of the frustoconical tube 22, through the one or more ports 170 of the ported ring 133. The shear ring 74 may be positioned such that it abuts the second side 137 of the ported ring 133 (FIGS. 10 and 10A).

When at least a predetermined flow rate and/or predetermined fluid pressure is applied to the plug assembly 20*a*, the plug assembly 20*a* may move to the second state (FIG. 15). First, the predetermined flow rate/predetermined fluid pressure forces the shear ring 174 against the ported ring 133, shearing the shear ring 174 away from the exterior surface 164 of the mandrel 24*a*. Then the mandrel 24*a* moves to the second position in which the mandrel 24*a* is positioned relative to the frustoconical tube 22*a* such that seating segment 171 of the mandrel 24*a* sealingly engages the second step 152 of the frustoconical tube 22*a*, thereby blocking fluid flow to the ported ring 133 and closing the fluid passageway.

Generally, the fluid passageway (between the exterior surface 164 of the mandrel 24*a* and the interior surface 146 of the frustoconical tube 22*a* within the tube bore 48 of the frustoconical tube 22, through the one or more ports 170 of the ported ring 133) may allow fluid to flow through the plug assembly 20*a* before the seating segment 171 of the mandrel 24*a* is sealingly seated, until a second predetermined flow rate and/or predetermined fluid pressure is applied. Then, as fluid flows through the ported ring 133, a pressure differential may be created between the proximal end 160 and the distal end 162 of the mandrel 24*a*. The magnitude of the pressure differential may be approximately proportional to the square of the magnitude of the flow rate passing through the ported ring 133. At a predetermined flow rate, the pressure differential creates a force that shears the shear ring 174 (and/or the first step 150) which allows the seating segment 171 of the mandrel 24*a* to contact the second step 152 of the frustoconical tube 22*a* and subsequently seal off any flow through the fluid passageway of the plug assembly 20*a*.

Figure 20:
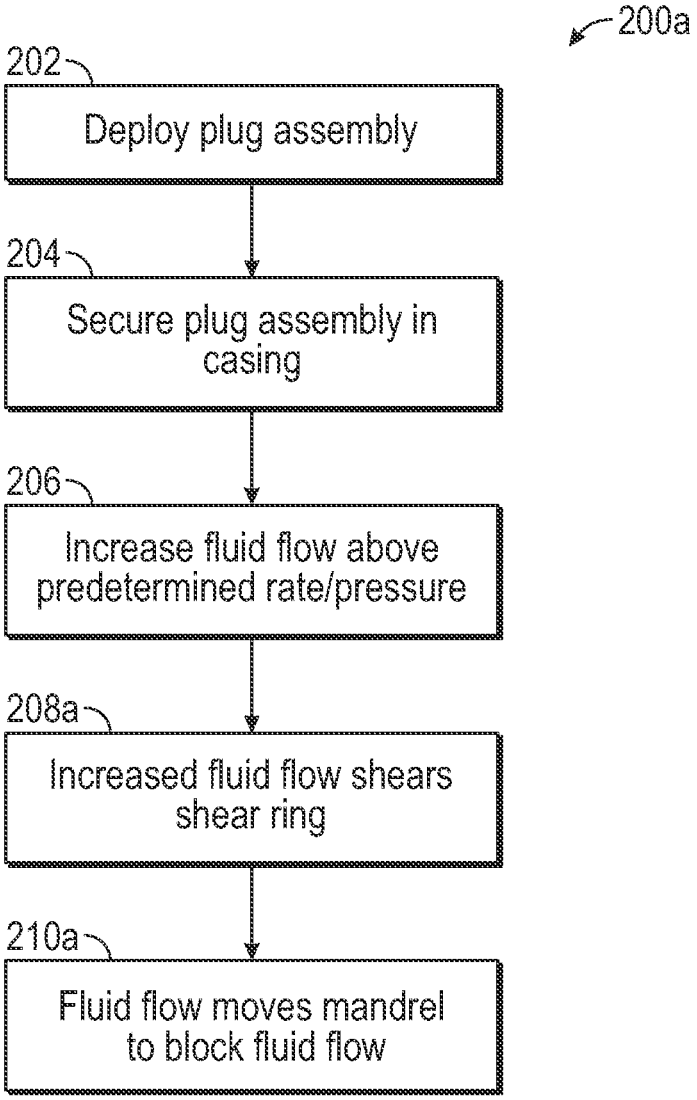
FIG. 20 is a process flow diagram of another exemplary method in accordance with the present disclosure.
Figure 21:
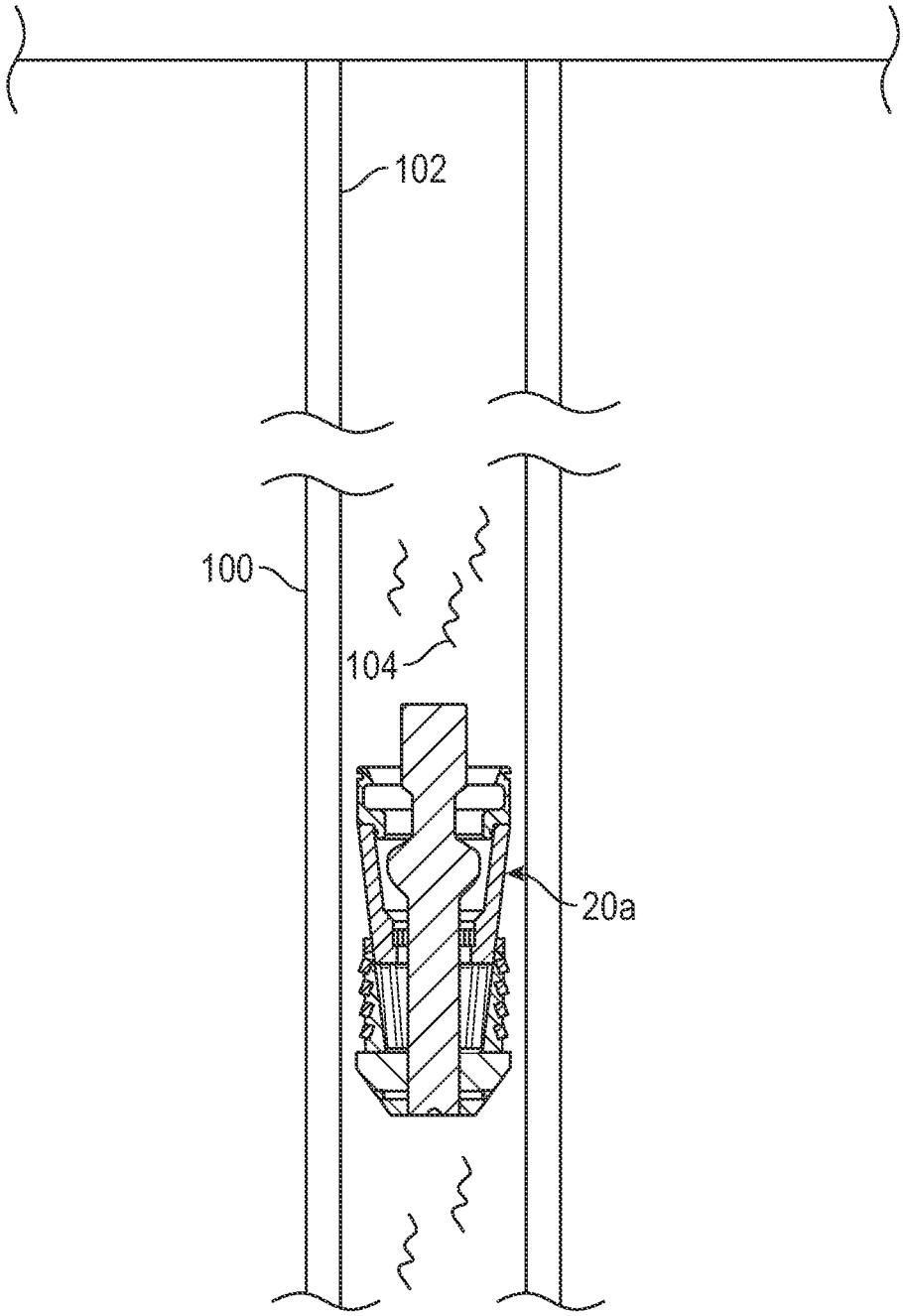
FIG. 21 is a cross-sectional view of the exemplary plug assembly of FIG. 8 in an initial state deployed in a downhole casing in accordance with the present disclosure.

FIG. 20 illustrates an exemplary method of use 200*a* of the plug assembly 20*a*. The method 200*a* of use of the plug assembly 20*a* is similar to that of the method 200 of use of the plug assembly 20. More particularly, in one implementation, the method 200*a* may include a step 202 of deploying the plug assembly 20*a* (FIGS. 9 and 10) and the setting tool 90 into the casing 100 within a drilled wellbore (FIG. 21).

Figure 22:
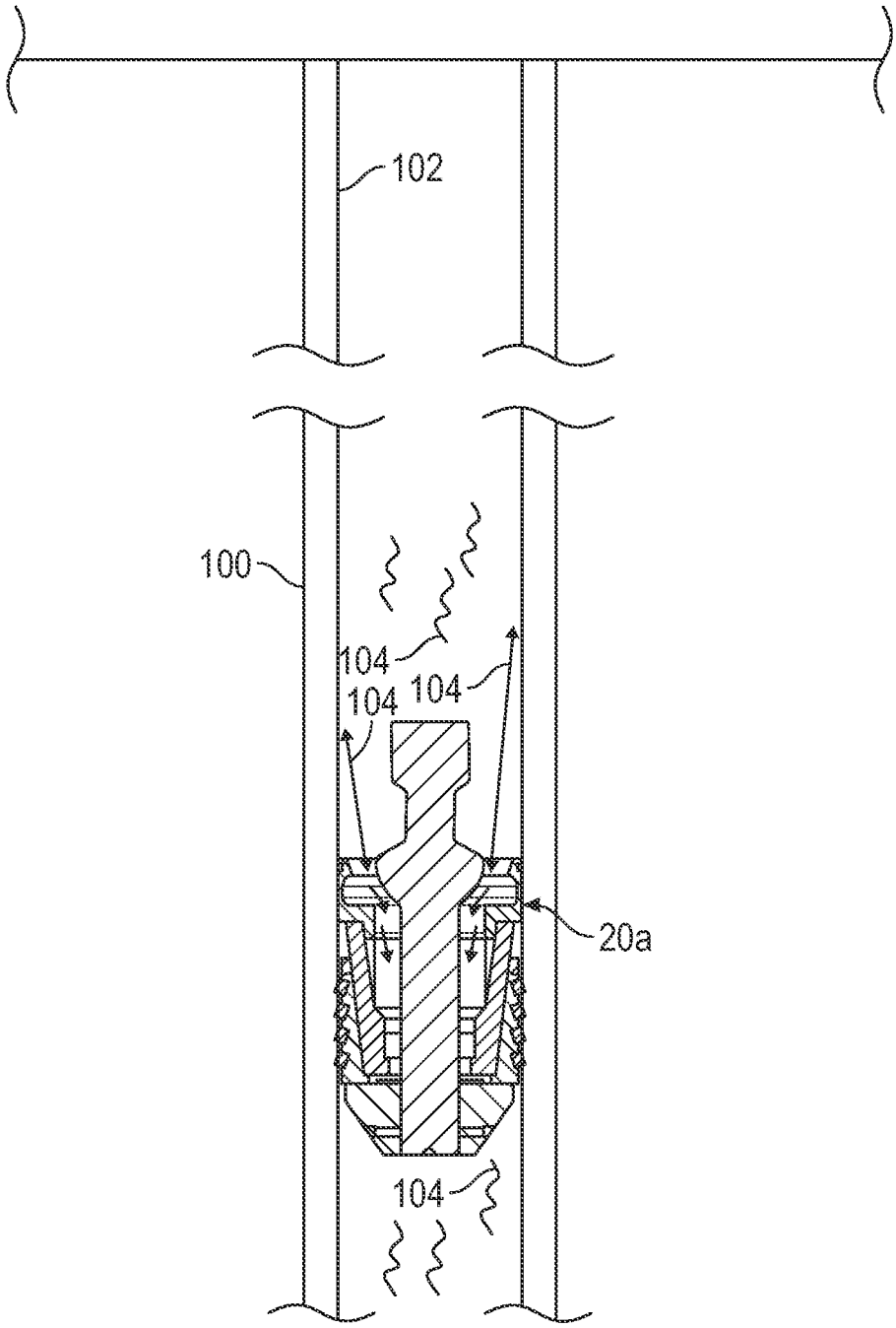
FIG. 22 is cross-sectional view of the exemplary plug assembly of FIG. 8 in which a slip member has been set, deployed in a downhole casing in accordance with the present disclosure.

A next step 204 may comprise securing the plug assembly 20*a* in the casing 100 (FIG. 22) by introducing a first fluid flow 104 into the casing 100 to longitudinally move the frustoconical tube 22*a* with the setting tool 90, thereby expanding the slip segments 80 of the slip member 26 (FIG. 13) and coupling the plug assembly 20*a* to an interior 102 of the casing 100 with the slip segments 80.

Figure 23:
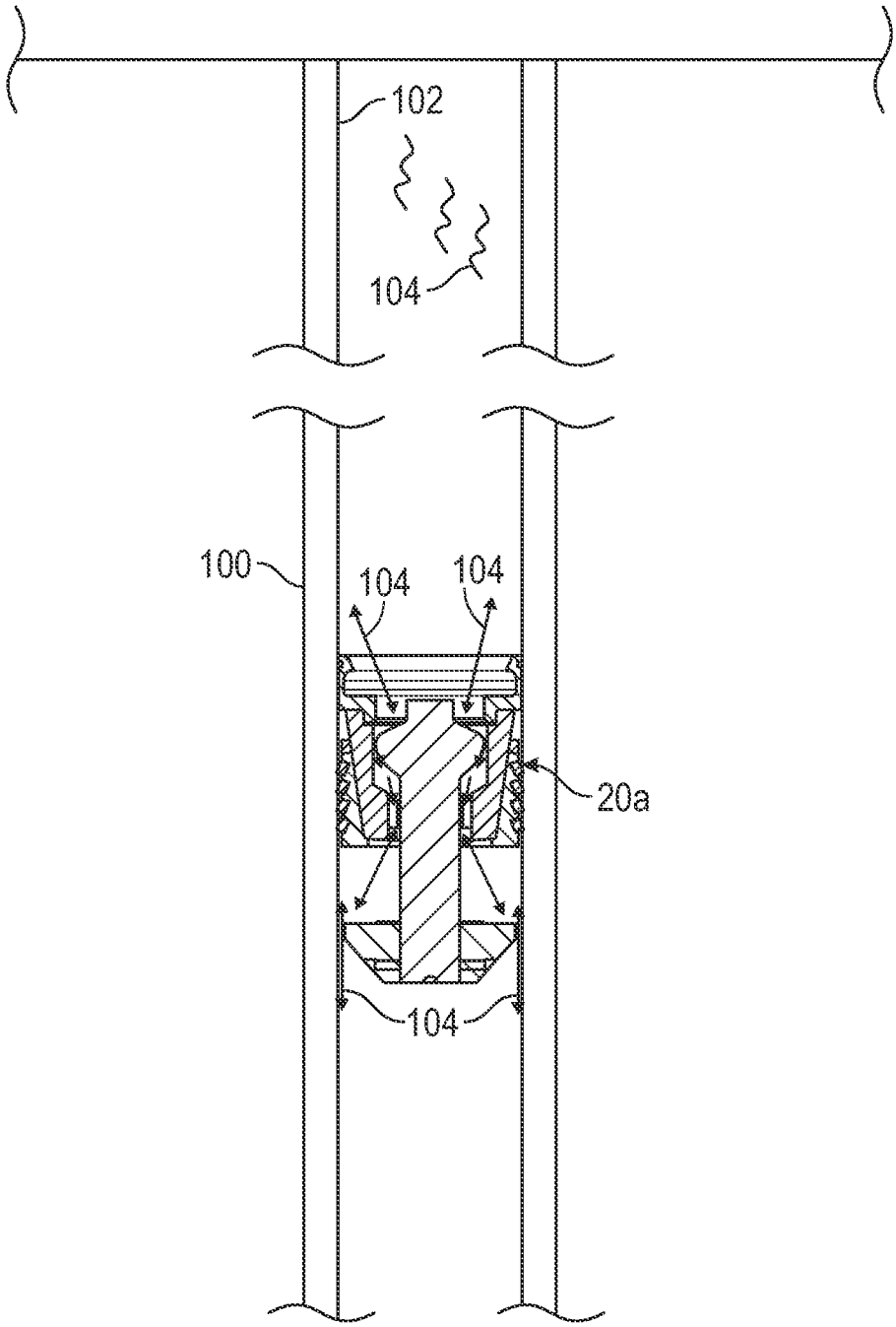
FIG. 23 is cross-sectional view of the exemplary plug assembly of FIG. 8 with a mandrel in a first position in a downhole casing in accordance with the present disclosure.

At this point, and when the mandrel 24*a* is moved initially longitudinally within the tube bore 148, the plug assembly 20*a* may be in the first state and the mandrel 24*a* of the plug assembly 20*a* may be in the first position relative to the frustoconical tube 22*a* such that the shear ring 174 is positioned between the seating segment 171 and the ported ring 133 (and/or abuts the ported ring 133), and the ported ring 133 abuts and the first step 150 of the frustoconical tube 22*a*. In the first position, the fluid passageway is formed between the exterior surface 164 of the mandrel 24*a* and the interior surface 146 of the frustoconical tube 22*a* within the tube bore 148, through the one or more ports 170 of the ported ring 133 (FIG. 10A and FIG. 23).

In some implementations, a portion of the proximal end 160 of the mandrel 24*a* may be removed.

In a next step 206, the fluid flow may be increased to above a second predetermined flow rate and/or second predetermined fluid pressure. In a next step 208*a*, when the second flow rate and/or predetermined fluid pressure is reached, a pressure differential may be created between the pressure on the proximate end 160 and the distal end 162 of the mandrel 24*a*. In some implementations, the magnitude of the pressure differential may be approximately proportional to the square of the magnitude of the flow rate passing through the fluid passageway through the mandrel 24*a*. At a predetermined flow rate, the pressure differential creates a force that pushes the shear ring 74 against ported ring 133, which is secured against the first step 150 of the frustoconical tube 22*a*, and shears the shear ring 174 from the exterior surface 164 of the mandrel 24*a*.

Figure 14:
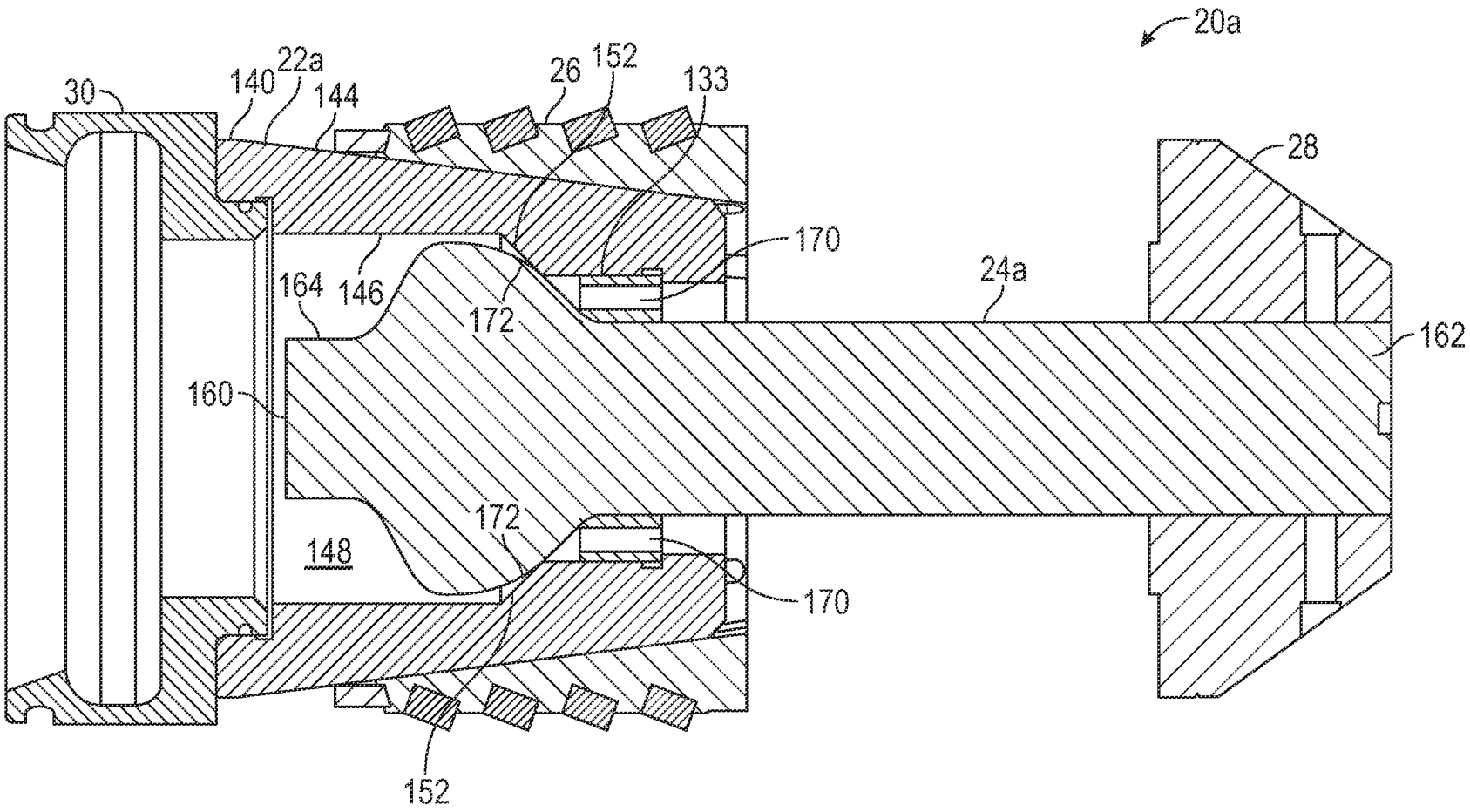
FIG. 14 is a cross-sectional view of the exemplary plug assembly of FIG. 8 in a second state, in accordance with the present disclosure.
Figure 24:
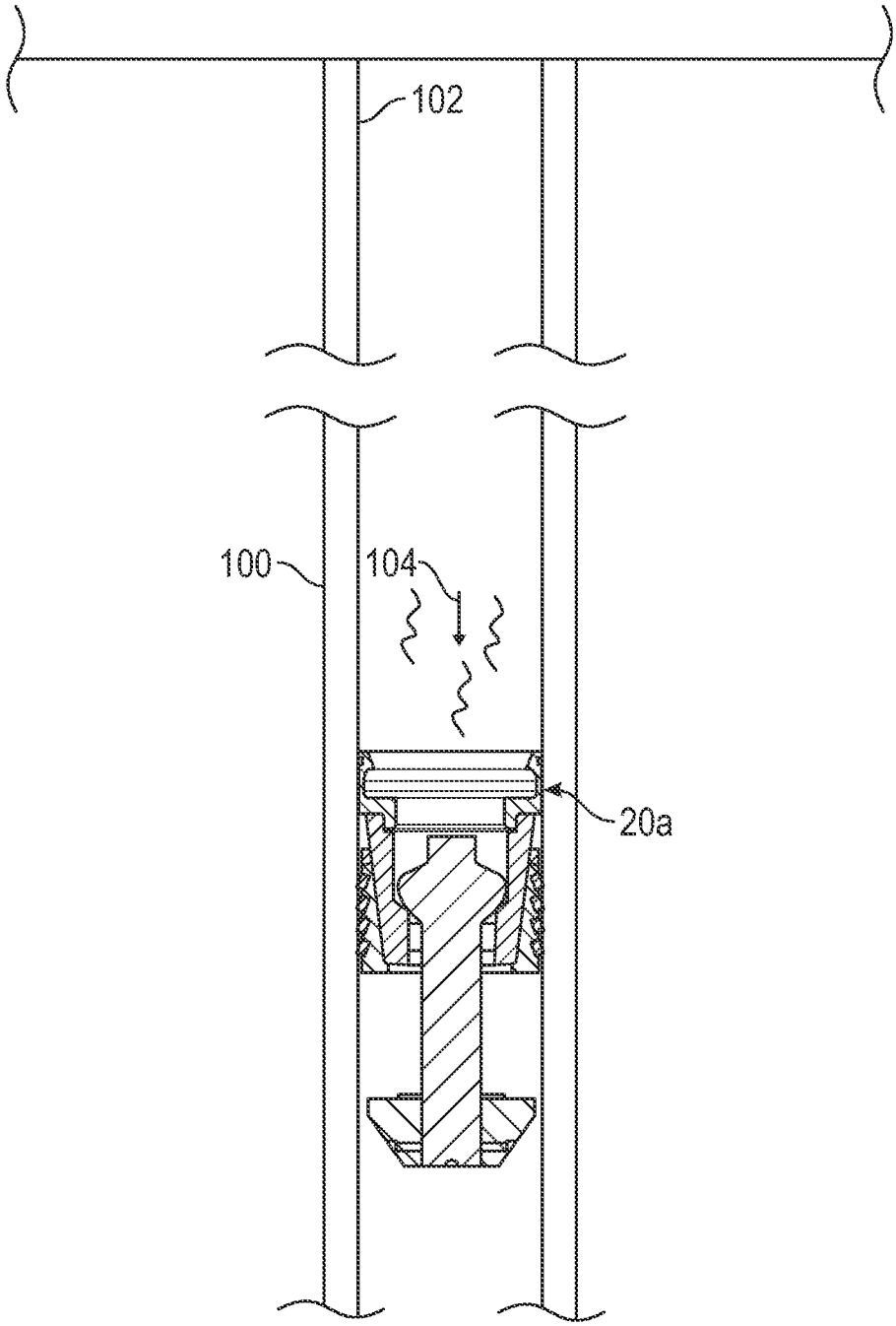
FIG. 24 is cross-sectional view of the exemplary plug assembly of FIG. 8 with a mandrel in a second position in a downhole casing in accordance with the present disclosure.

In step 210*a*, the fluid flow and/or fluid pressure may move the mandrel 24*a* longitudinally within the tube bore 148 to a second position such that the chamfered edge 172 of the seating segment 171 sealingly engages the second step 152 of the frustoconical tube 22*a*, thereby blocking fluid from the one or more ports 170 of the ported ring 133, closing the fluid passageway and stopping fluid flow through the plug assembly 20*a* (FIG. 14 and FIG. 24).

In some implementations, portions or all of the plug assembly 20, 20*a* may disintegrate after a predetermined amount of time exposed to fluid of the fluid flow 104 in the casing 100.

CONCLUSION

Conventionally, deploying components in downhole applications after a plug has been sealed has been time consuming and costly. In accordance with the present disclosure, plug assemblies may be set and sealed in a casing when exposed to a first predetermined fluid flow/pressure, but still allowing fluid passage through the plug assembly, and then sealed such that fluid cannot pass through the plug assembly at a second predetermined fluid flow/pressure.

The foregoing description provides illustration and description, but is not intended to be exhaustive or to limit the inventive concepts to the precise form disclosed. Modifications and variations are possible in light of the above teachings or may be acquired from practice of the methodologies set forth in the present disclosure.

Even though particular combinations of features are recited in the claims and/or disclosed in the specification, these combinations are not intended to limit the disclosure. In fact, many of these features may be combined in ways not specifically recited in the claims and/or disclosed in the specification. Although each dependent claim listed below may directly depend on only one other claim, the disclosure includes each dependent claim in combination with every other claim in the claim set.

No element, act, or instruction used in the present application should be construed as critical or essential to the invention unless explicitly described as such outside of the preferred embodiment. Further, the phrase "based on" is intended to mean "based, at least in part, on" unless explicitly stated otherwise.

What is claimed is:

1. A plug assembly, comprising:

a frustoconical tube having a first end, a second end, an exterior surface, and an interior surface, the interior surface defining a tube bore extending longitudinally through the frustoconical tube through the first end and the second end, the first end having a first inner diameter and the second end having a second inner diameter smaller than the first inner diameter, the interior surface having a first step circumferentially between the first end and the second end;

a tubular mandrel positioned longitudinally through the tube bore of the frustoconical tube, the tubular mandrel having a proximal end proximate to the first end of the frustoconical tube, a distal end extending through the second end of the frustoconical tube, an exterior surface, an interior surface defining a mandrel bore longitudinally through the tubular mandrel through the proximal end and the distal end, and one or more ports between the proximal end and the distal end fluidly connecting the mandrel bore with the exterior surface of the tubular mandrel, the tubular mandrel held in a first position relative to the frustoconical tube in which a fluid passageway is open between the exterior surface of the tubular mandrel at the proximal end of the tubular mandrel and the tube bore, through the one or more ports into the mandrel bore and through the distal end of the tubular mandrel;

a ported ring having an exterior surface a first side, a second side, a thickness extending between the first side and the second side, and one or more ports extending longitudinally through the thickness, the ported ring positioned circumferentially about the tubular mandrel, the exterior surface in contact with the interior surface of the frustoconical tube, and the second side in contact with the first step of the frustoconical tube, thereby creating a fluid passageway between the interior surface of the frustoconical tube and the exterior surface of the tubular mandrel via the one or more ports; and a ball positionable at least partially in the mandrel bore of the tubular mandrel at the proximal end and configured to fluidly seal the proximal end of the tubular mandrel;

wherein the tubular mandrel is configured to move between the first position and a second position in the frustoconical tube when a rate of fluid flow to the plug assembly is increased above a predetermined flow rate, wherein in the second position the tubular mandrel is positioned relative to the frustoconical tube such that the interior surface of the frustoconical tube blocks the one or more ports, thereby closing the fluid passageway.

2. The plug assembly of claim 1, wherein the interior surface of the frustoconical tube has a second step between the first step and the first end of the frustoconical tube, and wherein in the second position the second step blocks fluid flow from the one or more ports of the tubular mandrel.

3. The plug assembly of claim 2, wherein the exterior surface of the tubular mandrel has a mandrel step between the one or more ports and the proximal end, and wherein in the second position, the mandrel step of the exterior surface of the tubular mandrel is seated against the second step of the frustoconical tube such that the fluid passageway through the one or more ports is closed.

4. The plug assembly of claim 3, wherein the second step of the interior surface of the frustoconical tube is sloped and the mandrel step of the exterior surface of the mandrel is sloped such that the first step seated against the mandrel step creates a fluid impervious seal.

5. The plug assembly of claim 2, wherein the interior surface of the frustoconical tube is at least partially sloped between the first end and the second step of the frustoconical tube.

6. The plug assembly of claim 1, wherein the interior surface of the frustoconical tube is at least partially sloped between the first end and the first step.

7. The plug assembly of claim 1, wherein the first step is proximate to the second end of the frustoconical tube.

8. The plug assembly of claim 1, wherein the tubular mandrel has a shear ring extending from the exterior surface of the tubular mandrel and positioned between the one or more ports and the distal end, wherein in the first position the tubular mandrel is positioned relative to the frustoconical tube such that the shear ring contacts the interior surface of the frustoconical tube between the first step of the frustoconical tube and the first end of the frustoconical tube, and wherein the increase above the predetermined flow rate, creates a pressure differential between the proximal end and the distal end of the tubular mandrel, forcing the shear ring against the first step, resulting in a shear force sufficient to shear off the shear ring, thereby allowing fluid pressure to move the tubular mandrel to the second position.

9. The plug assembly of claim 1, further comprising a slip member having one or more slip segments, the slip member positioned at least partially circumferentially about the second end of the frustoconical tube such that the slip segments are pushed outwardly when the second end of the frustoconical tube moves longitudinally, the slip member having a sloped interior surface configured to engage the second end of the exterior surface of the frustoconical tube.

10. The plug assembly of claim 1, further comprising an end cap in contact with the second end of the tubular mandrel.

11. A method for sealing a plug assembly in a wellbore, comprising:

deploying a plug assembly and a setting tool into a casing within a drilled wellbore, the plug assembly comprising:

a frustoconical tube having first end, a second end, an exterior surface, and an interior surface, the interior surface defining a tube bore extending longitudinally through the frustoconical tube through the first end and the second end, the first end having a first inner diameter and the second end having a second inner diameter smaller than the first inner diameter, the interior surface having a first step circumferentially between the first end and the second end;

a tubular mandrel positioned longitudinally through the tube bore of the frustoconical tube, the tubular mandrel having a proximal end proximate to the first end of the frustoconical tube, a distal end extending through the second end of the frustoconical tube, an exterior surface, an interior surface defining a mandrel bore longitudinally through the tubular mandrel through the proximal end and the distal end, and one or more ports between the proximal end and the distal end fluidly connecting the mandrel bore with the exterior surface of the tubular mandrel, the tubular mandrel held in a first position relative to the frustoconical tube in which a fluid passageway is open between the exterior surface of the tubular mandrel at the proximal end of the tubular mandrel and the tube bore, through the one or more ports into the mandrel bore and through the distal end of the tubular mandrel;

a ball positionable at least partially in the mandrel bore of the tubular mandrel at the proximal end and configured to fluidly seal the proximal end of the tubular mandrel;

a ported ring having an exterior surface, a first side, a second side, a thickness extending between the first side and the second side and one or more ports extending longitudinally through the thickness, the ported ring positioned circumferentially about the tubular mandrel, the exterior surface in contact with the interior surface of the frustoconical tube, and the second side in contact with the first step of the frustoconical tube thereby creatin a fluid passageway between the interior surface of the frustoconical tube and the exterior surface of the tubular mandrel via the one or more ports; and a slip member having one or more slip segments, the slip member positioned at least partially around the second end of the frustoconical tube such that the slip segments are pushed outwardly when the second end of the frustoconical tube moves longitudinally, the slip member having a sloped interior surface configured to engage the second end of the exterior surface of the frustoconical tube;

securing the plug assembly in the casing by introducing fluid flow at a first flow rate into the casing to longitudinally move the frustoconical tube with the setting tool, thereby expanding the slip segments of the slip member and coupling the plug assembly to the casing with the slip segments; wherein the tubular mandrel of the plug assembly is in the first position relative to the frustoconical tube; and increasing the fluid flow to a second flow rate that is above a predetermined flow rate, causing the tubular mandrel to move to a second position relative to the frustoconical tube, in which the interior surface of the frustoconical tube blocks the one or more ports and closes the fluid passageway.

12. The method of claim 11, wherein the predetermined flow rate is 15 barrels/minute or more.

13. The method of claim 11, wherein the predetermined flow rate creates a pressure differential between pressure on the proximal end and the distal end of the tubular mandrel.

14. The method of claim 13, wherein a magnitude of the pressure differential is proportional to the square of the magnitude of a particular flow rate passing through the fluid passageway.

15. The method of claim 11, wherein the first step of the frustoconical tube is proximate to the second end of the frustoconical tube.

16. The method of claim 11, wherein the interior surface of the frustoconical tube has a second step between the first step and the first end of the frustoconical tube, and wherein in the second position the second step blocks fluid flow from the one or more ports of the tubular mandrel.

17. The method of claim 16, wherein the exterior surface of the tubular mandrel has a mandrel step between the one or more ports and the proximal end, and wherein in the second position, the mandrel step of the exterior surface of the tubular mandrel is seated against the second step of the frustoconical tube such that the fluid passageway through the one or more ports is closed.

18. The method of claim 11, wherein the interior surface of the tubular mandrel has a circumferential ball seat step between the one or more ports and the proximal end of the tubular mandrel.

19. The method of claim 18, wherein the ball seat step is sealingly engageable with the ball.

20. The method of claim 11, wherein the tubular mandrel has a shear ring extending from the exterior surface of the tubular mandrel and positioned between the one or more ports and the distal end, wherein in the first position the tubular mandrel is positioned relative to the frustoconical tube such that the shear ring contacts the interior surface of the frustoconical tube between the first step of the frustoconical tube and the first end of the frustoconical tube, and wherein increasing the fluid flow to the second flow rate that is above the predetermined flow rate shears the shear ring, causing the tubular mandrel to move to the second position relative to the frustoconical tube.

21. The method of claim 20, wherein increasing the fluid flow to the second flow rate that is above the predetermined flow rate creates a pressure differential between the proximal end and the distal end of the tubular mandrel, forcing the shear ring against the first step, and resulting in a shear force sufficient to shear off the shear ring.

22. A plug assembly, comprising:

a frustoconical tube having first end, a second end, an exterior surface, and an interior surface, the interior surface defining a tube bore extending longitudinally through the frustoconical tube through the first end and the second end, the interior surface having a first step circumferentially between the first end and the second end, and a second step circumferentially between the first step and the first end, the first end having a first inner diameter and the second end having a second inner diameter smaller than the first inner diameter;

a mandrel positioned longitudinally through the tube bore of the frustoconical tube, the mandrel having a proximal end proximate to the first end of the frustoconical tube, a distal end having a first diameter and extending through the second end of the frustoconical tube, an exterior surface, a seating segment between the proximal end and the distal end, the seating segment having a second diameter greater than the first diameter of the distal end, the seating segment configured to sealingly engage with the second step of the frustoconical tube;

a shear ring extending from the exterior surface and positioned between the seating segment and the distal end;

a ported ring having an exterior surface, a first side, a second side, a thickness extending between the first side and the second side, and one or more ports extending longitudinally through the thickness, the ported ring positioned circumferentially about the mandrel between the shear ring and the distal end, the exterior surface in contact with the interior surface of the frustoconical tube, and the second side in contact with the first step of the frustoconical tube, thereby creating a fluid passageway between the interior surface of the frustoconical tube and the exterior surface of the mandrel via the one or more ports; and wherein the mandrel is configured to move to a closed position in the frustoconical tube when the shear ring has been sheared away by the ported ring when a predetermined fluid pressure is applied to the plug assembly, wherein the mandrel is positioned relative to the frustoconical tube such that seating segment of the mandrel engages the second step of the frustoconical tube, thereby blocking fluid flow to the ported ring and closing the fluid passageway.

* * * * *